US009354588B2

(12) United States Patent
Takahashi et al.

(10) Patent No.: US 9,354,588 B2
(45) Date of Patent: May 31, 2016

(54) IMAGE FORMING APPARATUS AND IMAGE FORMING METHOD THAT REMOVE TONER FROM A CLEANING BLADE FOR AN IMAGE BEARER BY INVERSELY ROTATING THE IMAGE BEARER

(71) Applicants: Tomoko Takahashi, Kanagawa (JP); Taichi Urayama, Kanagawa (JP); Yasunobu Takagi, Kanagawa (JP); Hiroyuki Sugiyama, Kanagawa (JP); Masahiko Shakuto, Kanagawa (JP); Yoshinori Nakagawa, Kanagawa (JP); Shotaro Hoshi, Kanagawa (JP); Ryota Kidera, Tokyo (JP); Tatsumi Yamada, Kanagawa (JP)

(72) Inventors: Tomoko Takahashi, Kanagawa (JP); Taichi Urayama, Kanagawa (JP); Yasunobu Takagi, Kanagawa (JP); Hiroyuki Sugiyama, Kanagawa (JP); Masahiko Shakuto, Kanagawa (JP); Yoshinori Nakagawa, Kanagawa (JP); Shotaro Hoshi, Kanagawa (JP); Ryota Kidera, Tokyo (JP); Tatsumi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/714,158

(22) Filed: May 15, 2015

(65) Prior Publication Data

US 2015/0331383 A1 Nov. 19, 2015

(30) Foreign Application Priority Data

May 16, 2014 (JP) ..... 2014-102180

(51) Int. Cl.
*G03G 15/00* (2006.01)
*G03G 21/00* (2006.01)

(52) U.S. Cl.
CPC .... *G03G 21/0011* (2013.01); *G03G 2215/0132* (2013.01)

(58) Field of Classification Search
CPC ..... G03G 21/0011; G03G 2215/0132
USPC ..... 399/71, 343, 350
See application file for complete search history.

(56) References Cited

U.S. PATENT DOCUMENTS

| | | | | |
|---|---|---|---|---|
| 2005/0063734 | A1* | 3/2005 | Saito | G03G 21/0011 399/167 |
| 2008/0008490 | A1* | 1/2008 | Sanmonji | G03G 15/5008 399/71 |
| 2011/0150519 | A1* | 6/2011 | Kanazawa | G03G 15/5008 399/71 |

FOREIGN PATENT DOCUMENTS

| | | |
|---|---|---|
| JP | 2000-155514 | 6/2000 |
| JP | 2000-305440 | 11/2000 |
| JP | 2004-302458 | 10/2004 |
| JP | 2005-031431 | 2/2005 |

(Continued)

*Primary Examiner* — Billy Lactaoen
(74) *Attorney, Agent, or Firm* — Duft Bornsen & Fettig LLP

(57) ABSTRACT

An image forming apparatus includes an image bearer rotating in a first direction while bearing a toner image thereon in a normal image forming operation; a toner image forming device to form the toner image on the image bearer; a transferring device to transfer the toner image to a recording medium eventually; a cleaning blade to block toner remaining on image bearer without being transferred; and a controller. The controller controls the image bearer to perform an inverse rotation operation in which the image bearer rotates in a second direction opposite to the first direction after controlling the toner image forming device to perform a special image forming operation such that the amount of toner input to the cleaning blade in the special image forming operation is greater than the amount of toner input to the cleaning blade in the normal image forming operation, and then stopping the image bearer.

5 Claims, 9 Drawing Sheets

(56) References Cited

FOREIGN PATENT DOCUMENTS

| | | | |
|---|---|---|---|
| JP | 2006317480 A | * | 11/2006 |
| JP | 2007079126 A | * | 3/2007 |
| JP | 2007-199169 | | 8/2007 |
| JP | 2008-065097 | | 3/2008 |
| JP | 2010-243829 | | 10/2010 |
| JP | 2011-170320 | | 9/2011 |

* cited by examiner

| RANGE OF ENVIRONMENTAL CONDITIONS | TEMPERATURE A (°C) | CORRECTION COEFFICIENT Ai (/km) |
|---|---|---|
| A1 | A < 10 | −1/5 |
| A2 | 10 < A ≤ 15 | −1/10 |
| A3 | 15 < A ≤ 20 | −1/20 |
| A4 | 20 < A ≤ 25 | 1/20 |
| A5 | 25 < A ≤ 30 | 1/15 |
| A6 | 30 < A ≤ 35 | 1/10 |
| A7 | 35 < A | 1/5 |

FIG. 6

| TRAVEL DISTANCE (km) | TEMPERATURE (°C) | INDIVIDUAL FILMING COUNT VALUE (FC) (CALCULATED VALUE) | CUMULATIVE FILMING COUNT VALUE (F) |
|---|---|---|---|
| 0 | | | 0.000 |
| 1 | 20 < A ≤ 25 | 0.050 | 0.050 |
| 2 | 25 < A ≤ 30 | 0.067 | 0.117 |
| 3 | 25 < A ≤ 30 | 0.067 | 0.183 |
| 4 | 30 < A ≤ 35 | 0.100 | 0.283 |
| 5 | 25 < A ≤ 30 | 0.067 | 0.350 |
| 6 | 15 < A ≤ 20 | −0.050 | 0.300 |
| 7 | 15 < A ≤ 20 | −0.050 | 0.250 |
| 8 | 15 < A ≤ 20 | −0.050 | 0.200 |
| 9 | 10 < A ≤ 15 | −0.100 | 0.100 |
| 10 | 10 < A ≤ 15 | −0.100 | 0.000 |
| 11 | A < 10 | −0.200 | 0.000 |
| 12 | 20 < A ≤ 25 | 0.050 | 0.050 |
| 13 | 25 < A ≤ 30 | 0.067 | 0.117 |
| 14 | 25 < A ≤ 30 | 0.067 | 0.183 |
| 15 | 30 < A ≤ 35 | 0.100 | 0.283 |
| 16 | 30 < A ≤ 35 | 0.100 | 0.383 |
| 17 | 35 < A | 0.200 | 0.583 |
| 18 | 35 < A | 0.200 | 0.783 |
| 19 | 35 < A | 0.200 | 0.983 |
| 20 | 25 < A ≤ 30 | 0.067 | 1.050 |

IMAGE FORMING APPARATUS AND IMAGE FORMING METHOD THAT REMOVE TONER FROM A CLEANING BLADE FOR AN IMAGE BEARER BY INVERSELY ROTATING THE IMAGE BEARER

CROSS-REFERENCE TO RELATED APPLICATIONS

This patent application is based on and claims priority pursuant to 35 U.S.C. §119 to Japanese Patent Application No. 2014-102180 filed on May 16, 2014 in the Japan Patent Office, the entire disclosure of which is hereby incorporated by reference herein.

BACKGROUND

1. Technical Field

This disclosure relates to an image forming apparatus which forms an image using toner, and to an image forming method of forming an image using toner.

2. Description of the Related Art

Image forming apparatuses which form images as follows have been proposed. Specifically, in the image forming apparatuses, a surface of a photoconductor serving as an image bearer, which surface has been charged by a charging device, is exposed to laser light emitted by an irradiator to form a latent image on the surface of the photoconductor. Next, a developer, which includes at least a toner and which is contained in a developing device, is supplied to a rotatable developing roller arranged in the developing device, and the toner in the developer is adhered to the latent image in a development region, in which the developing roller is opposed to the photoconductor, to form a toner image on the surface of the photoconductor. The toner image on the surface of the photoconductor is transferred to a recording medium by a transferring device, and the toner image is then fixed to the recording medium by a fixing unit upon application of heat and pressure thereto. In addition, unnecessary materials such as residual toner adhered to the surface of the photoconductor are removed therefrom by a cleaning blade of a cleaner, which is contacted with the surface of the photoconductor.

SUMMARY

As an aspect of this disclosure, an image forming apparatus is provided which includes a rotatable image bearer, which rotates in a first rotation direction while bearing a toner image thereon in a normal image forming operation; a toner image forming device to form the toner image on the surface of the image bearer; a transferring device to transfer the toner image on the image bearer rotating in the first rotation direction to a recording medium eventually in the normal image forming operation; a cleaning blade contacted with the surface of the image bearer to block the toner, which remains on the surface of the image bearer without being transferred and which is input to the cleaning blade due to rotation of the image bearer in the first rotation direction, to clean the surface of the image bearer; and a controller to control the image forming apparatus. The controller controls the image bearer to perform an inverse rotation operation in which the image bearer rotates in a second rotation direction opposite to the first rotation direction after controlling the toner image forming device to perform a special image forming operation in which a special toner image is formed on the surface of the image bearer and then input to the cleaning blade in such a manner that the amount of the toner input to the cleaning blade in the special image forming operation is greater than the amount of the toner input to the cleaning blade in the normal image forming operation, and then stopping the image bearer rotating in the first direction.

As another aspect of this disclosure, an image forming method is provided which includes performing a normal image forming operation in which an image of toner is formed on a surface of an image bearer rotating in a first rotation direction; transferring the toner image on the image bearer rotating in the first rotation direction to a recording medium eventually in the normal image forming operation; blocking the toner with a cleaning blade, which toner remains on the surface of the image bearer without being transferred and which is input to the cleaning blade due to rotation of the image bearer in the first rotation direction, to clean the surface of the image bearer; performing a special image forming operation in which a special toner image is formed on the surface of the image bearer and then input to the cleaning blade in such a manner that the amount of the toner input to the cleaning blade in the special image forming operation is greater than the amount of the toner input to the cleaning blade in the normal image forming operation; and rotating the image bearer in a second rotation direction opposite to the first rotation direction after performing the special image forming operation, and then stopping the image bearer.

The aforementioned and other aspects, features and advantages will become apparent upon consideration of the following description of the preferred embodiments taken in conjunction with the accompanying drawings.

BRIEF DESCRIPTION OF THE SEVERAL VIEWS OF THE DRAWINGS

FIG. 6 is a table illustrating an example of variation of the cumulative filming count value (F);

DETAILED DESCRIPTION

When the above-mentioned conventional image forming apparatuses are allowed to settle over a long period of time without forming images, it is possible that a filming problem such that a film of the toner is adhered to the surface of the photoconductor occurs.

The object of this disclosure is to provide an image forming apparatus, which hardly causes the filming problem even when the image forming apparatus is allowed to settle over a long period of time.

Hereinafter an example of an image forming apparatus according to an embodiment of this disclosure will be described.

Initially, the basic configuration of the image forming apparatus will be described.

Figure 1:
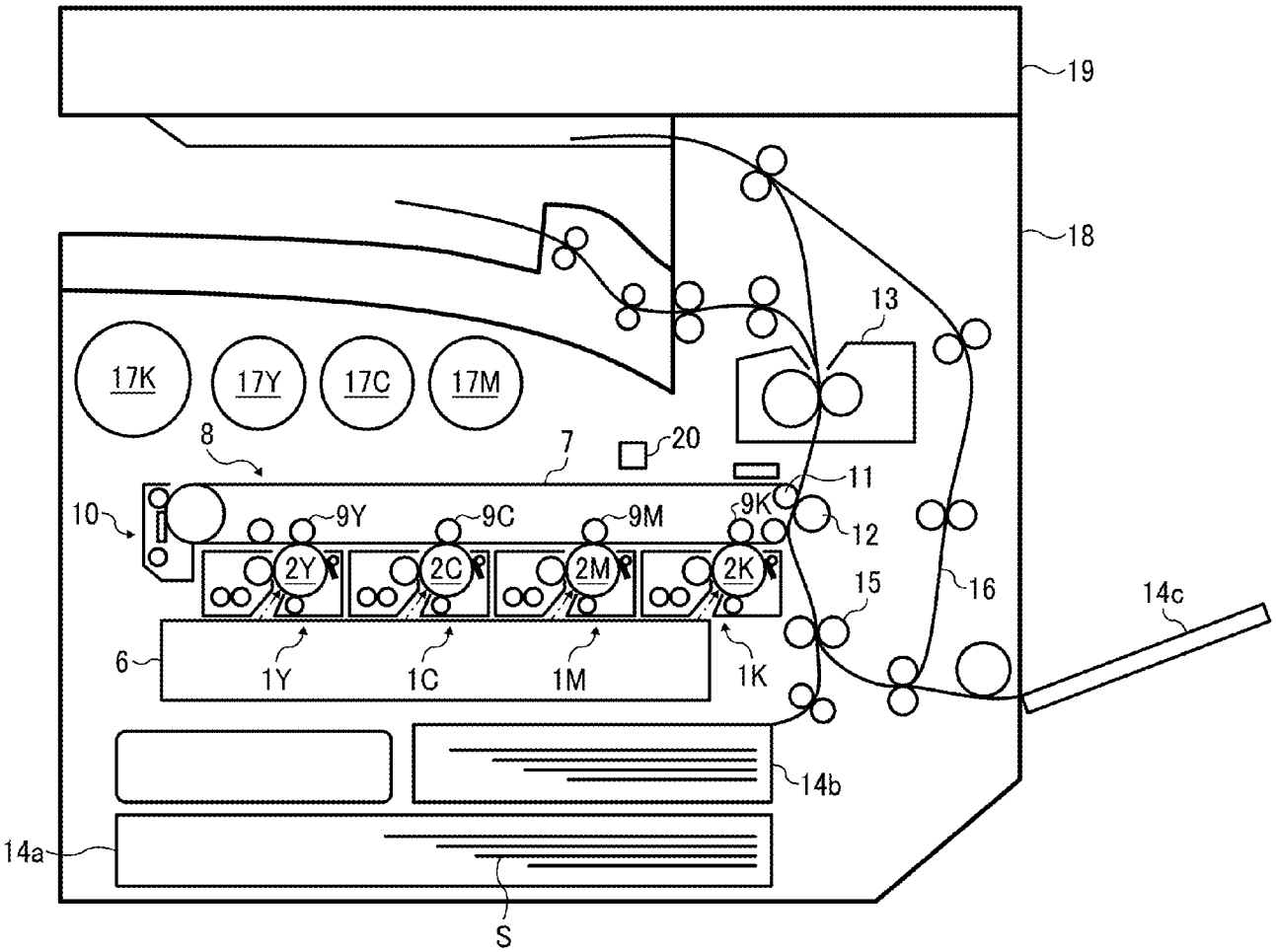
FIG. 1 is a schematic view illustrating an image forming apparatus according to an embodiment.

FIG. 1 is a schematic view illustrating an image forming apparatus according to an embodiment. Referring to FIG. 1, the image forming apparatus includes a printer part 18, and a scanner 19 located above the printer part 18. The printer part 18 includes four image forming units 1Y, 1C, 1M and 1K, which respectively form yellow (Y), cyan (C), magenta (M) and black (K) images. The arrangement (position) of the image forming units 1Y, 1C, 1M and 1K is not limited thereto, and any other arrangement can be available.

Figure 2:
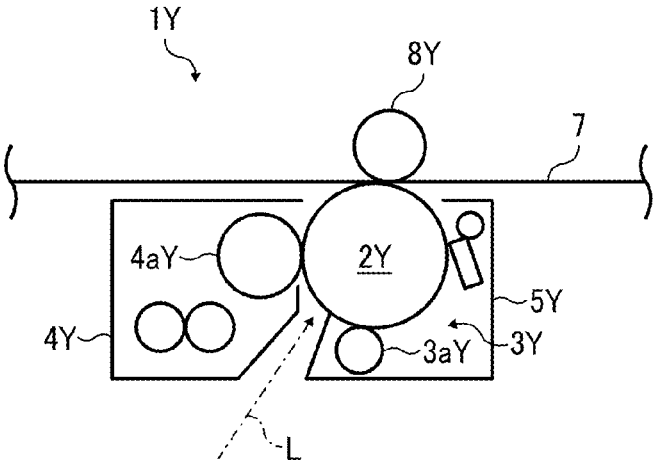
FIG. 2 is a schematic view illustrating an image forming unit of the image forming apparatus.

FIG. 2 is a schematic view illustrating an image forming unit (yellow image forming unit 1Y) of the image forming apparatus. Referring to FIG. 2, the yellow image forming unit 1Y includes a photoconductor 2Y serving as a rotatable image bearer, and a charging roller 3*a*Y of a charging device 3Y, a developing device 4Y serving as a developing equipment, and a cleaning device 5Y serving as a cleaner, which are arranged around the photoconductor 2Y. The charging device 3Y uses a contact DC charging roller method. However, the charging method is not limited thereto, and other charging methods such as contact AC charging roller methods, and non-contact charging roller methods can also be used. The developing device 4Y contains a two-component developer including a yellow toner and a magnetic carrier. The toner of the two-component developer used for the developing device 4Y has an average particle diameter of from 4.9 μm to 5.5 μm, and the carrier thereof has a bridge resistance of not greater than 12.1 (Log Ω·cm). Namely, the two-component developer includes a small particle toner and a low resistance carrier. In addition, the developing device 4Y includes a developing roller 4*a*Y which serves as a developer bearer and which is opposed to the photoconductor 2, a screw to feed and agitate the developer, and a toner concentration sensor (not shown in FIGS. 1 and 2). The developing roller 4*a*Y includes a rotatable sleeve, and a magnet located inside the sleeve.

The image forming unit 1Y is a process cartridge, in which the photoconductor 2Y, the charging device 3Y, the developing device 4Y, and the cleaning device 5Y are integrated as a unit while supported by a common support, and therefore, the image forming unit 1Y can be detachably attachable to the printer part 18. When the life of the image forming unit 1Y expires, the image forming unit is replaced with a new image forming unit (i.e., all the parts of the unit are replaced with new parts). The other image forming units 1C, 1M and 1K have the same configuration except that a toner having a different color (C, M or K color) is used therefor.

The image forming apparatus further includes an optical writing unit 6, which serves as a latent image forming device and which is located below the image forming units 1Y, 1C, 1M and 1K. The optical writing unit 6 includes a light source, a polygon mirror, a f-θ lens, and a reflection mirror, and irradiates a surface of each of the photoconductors 2Y, 2C, 2M and 2K with laser light L while scanning based on image data, thereby forming electrostatic latent images, which correspond to Y, C, M and K images to be produced, on the photoconductors 2Y, 2C, 2M and 2K, respectively.

The image forming apparatus further includes an intermediate transfer unit 8, which is located above the image forming units 1Y, 1C, 1M and 1K and which transfers toner images formed by the image forming units to a recording medium S such as paper sheets via an intermediate transfer belt 7. The intermediate transfer belt 7 is tightly stretched by plural rollers while rotated counterclockwise by one or more of the rollers. The intermediate transfer unit 8 further includes primary transfer rollers 9Y, 9C, 9M and 9K, a belt cleaning device 10 including a brush roller and a cleaning blade, a secondary transfer backup roller 11, and a reflection-type photosensor 20 which will be described later. The primary transfer rollers 9Y, 9C, 9M and 9K and the photoconductors 2 sandwich the intermediate transfer belt 7 to form primary transfer nips. The intermediate transfer unit 8 further includes a secondary transfer roller 12 which is located on a downstream side from the image forming unit 1K relative to the moving direction of the intermediate transfer belt 7 and which is opposed to the secondary transfer backup roller 11. The secondary transfer roller 12 and the secondary transfer backup roller 11 sandwich the intermediate transfer belt 7 to form a secondary transfer nip.

The image forming apparatus further includes a fixing unit 13, which is located above the secondary transfer roller 12. The fixing unit 13 includes a fixing roller and a pressure roller, which are opposed to each other. The fixing roller includes a halogen heater therein. An electric power is supplied to the halogen heater by a power source (not shown) so that the surface of the fixing roller has a predetermined temperature. The fixing roller and the pressure roller form a fixing nip.

Below the optical writing unit 6, sheet feeding cassettes 14*a* and 14*b* each containing plural sheets of the recording medium S on which output images are to be formed, and feeding rollers (not shown) and a pair of registration rollers 15 are arranged. In addition, a manual feed tray 14*c* is arranged on the right side of the printer part 18 to manually feed a recording medium. Further, a duplex printing unit 16 is arranged on the right side of the fixing unit 13 to feed the recording medium S bearing an image on one side thereof to the secondary transfer nip again when duplex printing is performed.

In addition, toner containers 17Y, 17C, 17M and 17*k* are arranged above the intermediate transfer unit 8 to supply Y, C, M and K toners to the image forming units 1Y, 1C, 1M and 1K, respectively. Further, other devices such as a waste toner bottle and a power source unit (not shown) are arranged in the printer part 18.

Next, the image forming operation (hereinafter sometimes referred to as a normal image forming operation) of the image forming apparatus will be described.

Initially, a predetermined voltage is applied to the charging roller 3*a*Y of the charging device 3Y by a power source (not shown) to charge a surface of the photoconductor 2Y. Next, the optical writing unit 6 scans the charged surface of the photoconductor 2Y with laser light L based on the image information, which is read by the scanner 19 or input from an external device such as personal computers, thereby forming an electrostatic latent image on the surface of the photoconductor 2Y. When the surface of the photoconductor 2Y bearing the electrostatic latent image reaches a development position at which the photoconductor 2Y is opposed to the developing roller 4*a*Y of the developing device 4Y, the developing roller 4*a*Y supplies the Y toner to the electrostatic latent image, thereby forming a yellow toner image on the surface of the photoconductor 2Y. In this regard, the charging device 3, the optical writing unit 6 and the developing device 4 serve as a toner image forming device. The yellow toner in the toner container 17Y is supplied to the developing device 4Y based on the concentration of toner in the developer in the developing device detected by a toner concentration sensor (not shown), which is provided in the developing device.

The above-mentioned image forming operation is performed with predetermined timing in each of the image forming units 1Y, 1C, 1M and 1K, thereby forming Y, C, M and K toner images on the photoconductors 2Y, 2C, 2M and 2K, respectively. The toner images thus formed on the photoconductors 2 are sequentially transferred to the intermediate transfer belt 7 at the primary transfer nips. In this regard, transfer of the toner images is performed by a voltage which is applied to each of the primary transfer rollers 9Y, 9C, 9M and 9K by a power source (not shown) and whose polarity is opposite to that of the charge of the toners on the photoconductors 2.

The recording medium S is fed from one of the sheet feeding cassettes 14*a* and 14*b* and the manual feed tray 14*c*, and is stopped once by the pair of registration rollers 15. The recording medium S is then fed toward the secondary transfer nip with predetermined timing by the pair of registration rollers 15.

The four color toner images overlaid on the intermediate transfer belt 7 are transferred onto the recording medium S at the secondary transfer nip formed by the secondary transfer roller 12 and the intermediate transfer belt 7. In this regard, transfer of the toner images is performed by a voltage which is applied to the secondary transfer roller 12 by a power source (not shown) and whose polarity is opposite to that of the charge of the toners on the intermediate transfer belt 7.

The recording medium S is then fed from the secondary transfer nip to the fixing unit 13, and the toner images on the recording medium S are fixed thereto by the heat applied by the fixing roller at the fixing nip. When one-side printing is performed, the recording medium S bearing the fixed toner images thereon is discharged from the printer part 18 by feeding rollers. When duplex printing is performed, the recording medium S bearing the fixed toner images thereon is fed to the duplex printing unit 16 so that the recording medium S is fed to the secondary transfer nip again while inverted and another toner image is transferred to the opposite side of the recording medium. The recording medium S is then fed to the fixing unit 13 again to fix the toner image formed on the opposite side of the recording medium, and the recording medium bearing the fixed toner images on both sides thereof is then discharged from the printer part 18 by the feeding rollers.

Next, the cleaning device 5 will be described.

Figure 3:
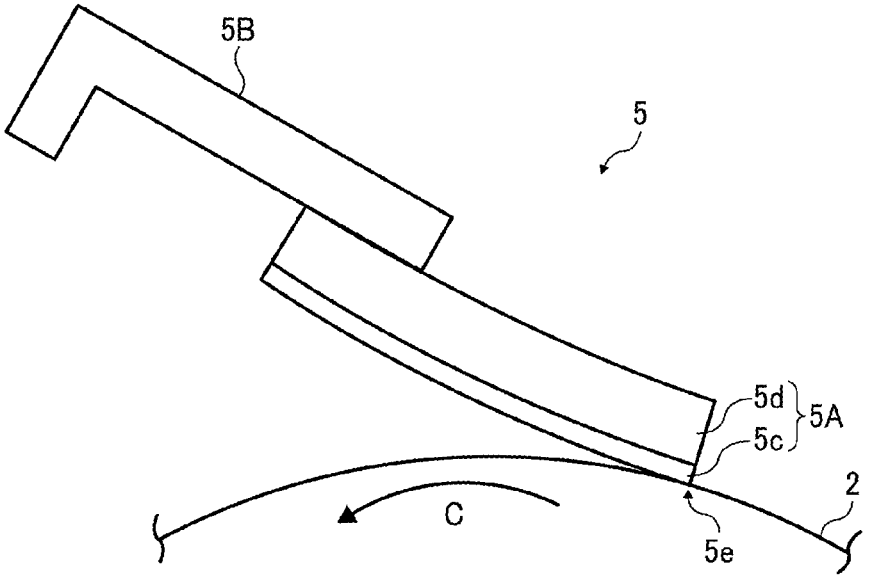
FIG. 3 is a schematic view illustrating a portion of the image forming apparatus, in which a cleaning blade is contacted with a photoconductor, from a direction parallel to the rotation axis of the photoconductor.

FIG. 3 is a schematic view illustrating a portion of the image forming apparatus, in which a cleaning blade is contacted with a photoconductor, from a direction parallel to the rotation axis of the photoconductor 2.

The cleaning device 5 includes a blade member 5A which has a multi-layered structure and is constituted of plural elastic material layers, and a blade holder 5B to hold one end of the blade member 5A. The blade member 5A is constituted of an edge layer 5*c*, which is contacted with the surface of the photoconductor 2, and a backup layer 5*d*, which is located on the backside of the edge layer 5*c*, wherein the edge layer and the backup layer have different permanent elongation values. An edge 5*e* of the edge layer 5*c* of one end of the blade member 5A, which end is not supported by the blade holder 5B, is contacted with the surface of the photoconductor 2 rotating in a direction C to clean the surface of the photoconductor 2. The edge layer 5*c* having the edge 5*e* is made of an elastic material whose permanent elongation value is greater than that of the elastic material constituting the backup layer 5*d*.

Specifically, an elastic material having a large permanent elongation value and a large 100% modulus value is used for the edge layer 5*c*, and another elastic material having a permanent elongation value and a 100% modulus value, which are relatively small compared with those of the elastic material constituting the edge layer, is used for the backup layer 5*d*. In this regard, the thickness of each of the edge layer 5*c* and the backup layer 5*d* is adjusted such that when the blade member 5A is mounted to the cleaning device 5, the rate of decrease in linear pressure is not less than 90%.

The digging amount d (mm) (i.e., the blade member is longer by a predetermined amount d than the gap between the tip of the blade member 5A and the surface of the photoconductor 2), the contact pressure f (g/cm), and the contact angle $\alpha$ (°) of the blade member 5A are set to proper values based on the physical properties of the blade member 5A. For example, the digging amount d (mm) is greater than 0 and less than 1.5, the contact pressure f (g/cm) is not less than 10 and not greater than 80, and the contact angle $\alpha$ (°) is not less than 5 and not greater than 25.

As mentioned above, a material having high hardness and high 100% modulus is used for the edge layer 5*c*, which is contacted with the photoconductor 2. By using such a material for the edge layer 5*c*, the nip width does not unnecessarily increase when the edge layer is contacted with the photoconductor 2, and therefore the cleaning blade can obtain a high peak pressure necessary for blocking recent toner, which has a small particle diameter and a high circularity. In addition, even when the frictional force between the cleaning member 5A and the photoconductor 2 varies due to formation of images having different patterns, the cleaning blade, which is made of a material having high hardness and high 100% modulus, has small nip-width variation, and thereby variation of the contact pressure and peak pressure can be reduced. Therefore, the cleaning blade has small variation in cleaning property, and can stably maintain good cleaning property (i.e., good film removing property) over a long period of time.

In contrast, a material having hardness, 100% modulus, and permanent elongation value, which are relatively low compared with those of the material used for the edge layer 5*c*, is used for the backup layer 5*d*. When only a material suitable for the edge layer 5*c* (i.e., a material having high hardness, high 100% modulus, and high permanent elongation value) is used for the blade member 5A, the cleaning blade cannot stably maintain a proper linear pressure due to deterioration of the blade caused by elapse of time and change of environmental conditions. In contrast, when a material having hardness, 100% modulus, and permanent elongation value, which are relatively low compared with those of the material used for the edge layer 5*c*, is used for the backup layer 5*d*, deterioration of the blade can be prevented. Specifically, when a material having a permanent elongation value of not less than 2% and a high 100% modulus value is used for the edge layer 5*c* and a material having a permanent elongation value of not greater than 2% is used for the backup layer 5*d*, the resultant cleaning blade can produce an effect such that the cleaning blade is not deteriorated even when polymerization toner having a small particle diameter and a spherical form is used, and therefore the cleaning blade can maintain good cleaning property (i.e., film removing property) from the early stage over a long period of time.

It is preferable for the blade member 5A that variation of the viscoelasticity property of the edge layer 5*c* is as small as possible even when the environmental conditions vary. Therefore, it is preferable to use a rubber material, which has small variation in impact resilience coefficient even when the temperature changes, for the edge layer 5*c*. In addition, it is also preferable to use a rubber material, which has small variation in impact resilience coefficient even when the temperature changes, for the backup layer 5*d*, whose 100% modulus value and permanent elongation value are relatively low compared with those of the edge layer 5*c*. By using such materials for the edge layer 5*c* and the backup layer 5*d*, the resultant blade member 5A can maintain good durability while having good toner removing property even when environmental conditions change. Specifically, when dependence of the impact resilience of the blade member 5A on temperature change is low, the blade member can stably perform the cleaning operation even when the environmental temperature changes, and therefore the blade member can maintain good cleaning property (film removing property) over a long period of time.

It is preferable to use a rubber material having a tan δ peak temperature of lower than 10° C. for each of the edge layer 5*c* and the backup layer 5*d*. By using such a rubber material, each of the edge layer 5*c* and the backup layer 5*d* can function well as a rubber material even at a low temperature of 10° C., and therefore the blade member 5A can have the desired cleaning property. In this regard, as the tans peak temperature of the rubber material used for the edge layer 5*c* and the backup layer 5*d* decreases, the lower limit temperature, above which the blade member 5A can be used, decreases. Specifically, when a rubber material having a tan δ peak temperature of lower than 5° C. is used for each of the edge layer 5*c* and the backup layer 5*d*, each of the edge layer 5*c* and the backup layer 5*d* can function well as a rubber material at an environmental temperature of not lower than 5° C., and therefore the blade member 5A can have the desired cleaning property under the environmental conditions. When a rubber material having a tan δ peak temperature of lower than −20° C. is used for each of the edge layer 5*c* and the backup layer 5*d*, each of the edge layer 5*c* and the backup layer 5*d* can function well as a rubber material at an environmental temperature of not lower than −20° C., and therefore the blade member 5A can have the desired cleaning property under the environmental conditions.

The blade member 5A is contacted with the photoconductor 2 from the counter direction (i.e., in a counter contact manner) in FIG. 3. However, the contact manner is not limited thereto, and the trailing contact manner can also be available.

Figures 4, 5:
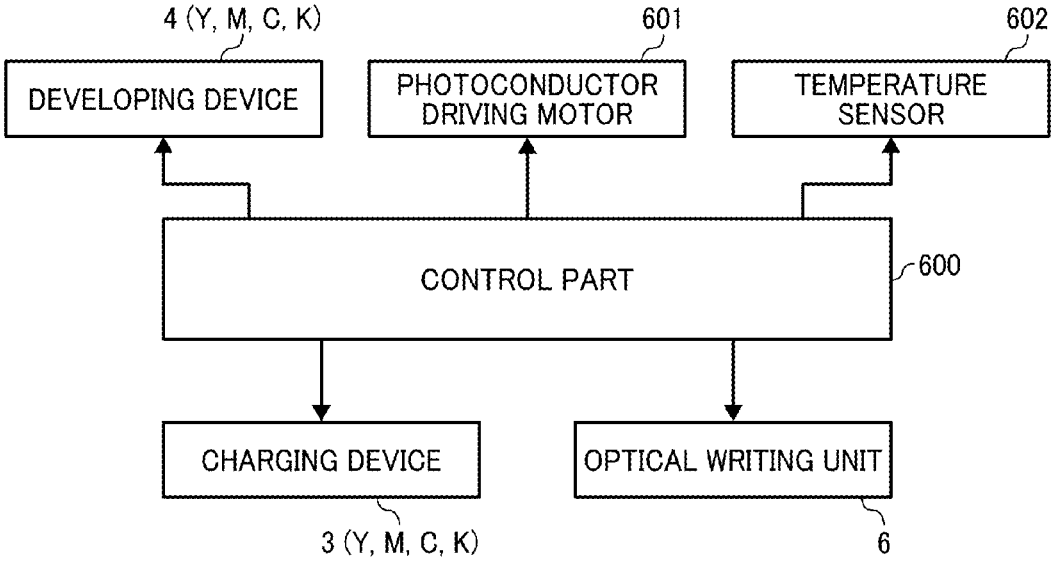
FIG. 4 is a control block diagram of the image forming apparatus.
FIG. 5 is a table illustrating an example of the relationship between the temperature environment and the correction coefficient for use in control of forming a strip-shaped toner pattern in the image forming apparatus.

FIG. 4 is a control block diagram of the image forming apparatus.

Referring to FIG. 4, a control part 600 serving as a controller includes a central processing unit (CPU) serving as a computing device, and a random access memory (RAM) and a read only memory (ROM), which serve as memories. The control part 600 controls the entirety of the image forming apparatus, and are connected with various devices and sensors of the image forming apparatus. However, some of the devices and sensors of the image forming apparatus are illustrated in FIG. 4. The control part 600 performs drive control on the devices and sensors based on the control program stored in the ROM. In addition, as mentioned below in detail, the control part 600 performs a control operation (i.e., a special toner image forming operation) such that a toner image is formed on the photoconductor so as to be input to the cleaning device 5 with predetermined timing. Further, the control part 600 controls a photoconductor driving motor 601 to inversely rotate the photoconductor after an image forming operation (i.e., a normal image forming operation) is ended.

A need for energy-saving electrophotographic image forming apparatus is increasing now. Among electrophotographic image forming processes, the fixing process, in which toner, which constitutes a toner image and is typically made of a resin, is softened and melted to be fixed to a recording medium, largely affects the energy consumption. Therefore, in order to meet the energy-saving need, the image forming apparatus of this disclosure uses a low temperature fixable toner constituted of a resin which is fixable at a relatively low temperature. In general, when resin is heated, the resin causes crystal transition at a glass transition temperature Tg, and then rapidly achieves a melted state from a solid state, thereby decreasing the viscosity thereof, resulting in fixation of the resin (toner) to a recording medium. When a crystalline polyester resin is used for toner, good low temperature fixability can be imparted to the toner without excessively decreasing the glass transition temperature (Tg) and the molecular weight of the polyester resin.

Image forming apparatus using such a low temperature fixable toner tends to cause the filming problem such that a small amount of toner is adhered as a film to a surface of a rotating latent image bearer such as photoconductors with time.

The mechanism of adherence (filming) of toner to the photoconductor 2 will be described.

1. Step 0 (Formation of Scratch on the Surface of the Photoconductor)

The carrier included in the developer born on the developing roller 4*a* scratches the surface of the photoconductor 2 when the developing roller and the photoconductor are driven to rotate. Further, in the developing operation, the toner and the external additive of the toner is supplied to the surface of the photoconductor 2 in the development region. In addition, the free external additive released from the toner in the developing device is also supplied to the photoconductor 2 by the carrier together with the toner. The toner and the external additive are transported to the cleaning device 5 by the rotated photoconductor 2. The toner and part of the external additive can be blocked by the cleaning blade of the cleaning device 5, but part of the external additive passes through the nip between the blade member 5A and the surface of the photoconductor 2 while abrading the surface of the photoconductor, thereby scratching the surface of the photoconductor.

2. Step 1 (Adherence of the Toner to the Scratches of the Photoconductor)

The toner (i.e. residual toner), which remains on the photoconductor 2 without being transferred to the recording medium (or in a tandem image forming apparatus illustrated in FIG. 1, the toner (i.e., residual toner), which remains on the photoconductor 2 without being transferred to the intermediate transfer belt 7 at the primary transfer nip, and the toner (i.e., inversely-transferred toner), which remains on the intermediate transfer belt 7 without being transferred to the recording medium at the secondary transfer nip and is retransferred to the photoconductor 2), is transported to the cleaning device 5. The most part of the thus transported residual toner and the inversely-transferred toner is blocked by the blade member 5A. However, part of the transported residual toner and the inversely-transferred toner passes through the nip between the blade member 5A and the surface of the photoconductor 2 while entering into the scratches on the surface of the photoconductor 2, which are formed in STEP 0.

3. Step 2 (Formation of Film)

The residual toner and the external additive passing though the nip between the blade member 5A and the surface of the photoconductor 2 are adhered to the toner entering into the scratches, which serves as a core, resulting in growth of the core, thereby forming a toner film on the surface of the photoconductor 2 (i.e., causing the filming problem).

Next, the reason why the image quality deteriorates when the filming problem is caused will be described.

The external additive of toner typically includes a material having moisture absorbing property. When a toner film including such a hygroscopic material is formed on the surface of the photoconductor 2, the toner film absorbs moisture in the air. In this case, the electric resistance of the toner film decreases, thereby affecting the potential of the electrostatic latent image formed on the photoconductor. Specifically, charges formed in the charge generation layer of the photoconductor 2 by exposure are normally transported to the irradiated surface of the photoconductor through the charge transport layer, thereby cancelling the charges formed on the surface of the photoconductor in the charging process, and therefore the potential of the irradiated surface of the photoconductor decreases to the desired potential. However, when a toner film whose electric resistance is decreased due to absorption of moisture is present in the vicinity of the irradiated surface, the charges transported through the charge transport layer scatter in the toner film, and therefore the charges are not transported to the irradiated surface of the photoconductor. As a result, the potential of the irradiated surface of the photoconductor cannot be decreased to the desired potential. In this case, a problem which occurs is that the toner is not adhered to the portion of the electrostatic latent image, or the toner is adhered to a portion other than the electrostatic latent image, resulting in formation of a white spot image in an image or occurrence of background development in which background of an image is soiled with the toner or has a black (colored) spot image. In this regard, qualities of halftone images are particularly deteriorated by the toner film.

Thus, when the filming problem is caused, the image quality deteriorates and therefore it becomes difficult to form a desired toner image on the photoconductor 2. Therefore, in order to stably produce quality images over a long period of time, it is preferable to stably scrape off the toner film together with the outermost part of surface of the photoconductor 2 using the blade member 5A over a long period of time.

It is known from recent research that the degree of scraping with the blade member 5A changes depending on the conditions of the edge 5*e* of the blade member. Specifically, the degree of scraping relates to the contact pressure of the edge 5*e* to the photoconductor 2, the amount of toner blocked by the blade member 5A, and the conditions of the external additive of the toner, and therefore it is preferable to bring these factors into balance to perform the scraping operation.

In order to well perform the scraping operation, it is preferable to contact the blade member 5A with the surface of the photoconductor 2 at a high contact pressure. In this regard, by using a material having a 100% modulus value of from 6 MPa to 12 MPa at 23° C. for the edge layer 5*c*, the blade member 5A can perform good scraping operation.

In general, an additive (external additive) is added to a toner including a low temperature fixable resin to add a function to the resin. When the toner stays between the blade member 5A and the surface of the photoconductor 2, the additive abrades the surface of the photoconductor. The conditions of the abraded surface and the amount of the abraded surface depend on choice of material for the additive and the added amount of the additive. As mentioned below, the additive of the toner used for the image forming apparatus of this disclosure includes united particles in which plural primary particles of the additive are united. Since such united particles have irregular forms, the united particles have good abrading/removing ability. Even when such united particles are not included in the additive, the additive can abrade the surface of the image bearer such as photoconductors, but the abrading ability thereof is low. Therefore, depending on the conditions of the toner film formed on the photoconductor 2, there is a case in which the additive cannot abrade the surface of the photoconductor 2 in a sufficient amount, and therefore the additive cannot satisfactorily scrape off the toner film.

Thus, in the image forming apparatus of this disclosure, the blade member 5A has the configuration mentioned above, and a toner including an additive including united particles is used. Therefore, the image forming apparatus can maintain good film removing property over a long period of time, thereby making it possible to prevent occurrence of the filming problem. However, it is hard to perfectly remove toner films, and a toner film may be formed on the photoconductor 2 when the image forming apparatus is used over a long period of time.

In the film removing operation, a good effect can be produced by scraping off the film with the toner staying in a wedge-shaped small gap (such as a portion H illustrated in FIG. 14) formed by the tip surface of the blade member 5A and the surface of the photoconductor 2. In order to enhance this effect, it is preferable to increase the amount of toner staying in the wedge-shaped small gap.

Therefore, in the image forming apparatus of this disclosure, a strip-shaped toner pattern is formed with predetermined timing on a non-image forming area of the surface of the photoconductor 2 so that the toner pattern is input to the wedge-shaped small gap formed by the blade member 5A and the surface of the photoconductor 2, thereby making it possible to increase the amount of toner staying in the wedge-shaped small gap, resulting in enhancement of the film removing effect. Hereinafter, this strip-shaped toner pattern forming operation is sometimes referred to as a special image forming operation to distinguish the special image forming operation from the normal image forming operation mentioned above.

However, when such a strip-shaped toner pattern is continuously or intermittently input to the wedge-shaped small gap right after a toner film is formed on the photoconductor, formation of scratches on the surface of the photoconductor is accelerated on the contrary, thereby increasing the film increase rate, resulting in occurrence of a problem in that the life of the photoconductor 2 is shortened.

In the image forming apparatus of this disclosure, a strip-shaped toner pattern is formed based on a filming count value FC, which is an index value of filming and which is calculated based on the travel distance of the photoconductor 2, which is the image forming operation time of the image forming apparatus or a parameter relating to the image forming operation time, and the ambient temperature of the photoconductor 2 detected by a temperature sensor 602. Specifically, the cumulative value of the filming count value FC, which is hereinafter referred to as a cumulative filming count value F, is calculated, and when the cumulative filming count value F exceeds a predetermined value, a strip-shaped toner pattern forming operation is performed to input the strip-shaped toner pattern to the blade member 5A. This control operation will be described in detail.

The amount of the toner films formed on the surface of the photoconductor 2 increases in almost direct proportion to the image forming operation time of the photoconductor (i.e., the image forming apparatus). However, when the ambient temperature of the photoconductor 2 changes, the hardness of the blade member 5A also changes, resulting in change of the film removing property of the blade member 5A. In addition, when the ambient temperature of the photoconductor 2 changes, adherence of the additive of the toner to the surface of the photoconductor 2 changes. Therefore, it is necessary to determine the amount of the toner films in consideration of the change of the film removing property of the blade member and the adherence property of the additive of the toner. Specifically, in the image forming apparatus of this disclosure, the filming count value FC (index value) is calculated as follows.

$$FC=T\times Ai,$$

wherein T represents the image forming operation time of the image forming apparatus or a parameter relating to the image forming operation time, and Ai represents a correction coefficient.

When the cumulative value of the filming count value FC (i.e., the cumulative filming count value F, cumulative index value) exceeds a predetermined value, the strip-shaped toner pattern forming operation is performed to input the strip-shaped toner pattern to the blade member 5A. In this image forming apparatus, the travel distance of the photoconductor 2 is used as the parameter relating to the image forming operation time. However, the parameter is not limited thereto, and for example the number of prints can also be used. When the image forming operation time is used for determining the filming count value FC, the image forming operation time can be determined based on the operation time of the photoconductor driving motor 601 or the like.

FIG. 5 is a table illustrating an example of the relationship between the temperature environment and the correction coefficient.

FIG. 6 is a table illustrating an example of variation of the filming count value FC and the cumulative filming count value F.

Figure 7:
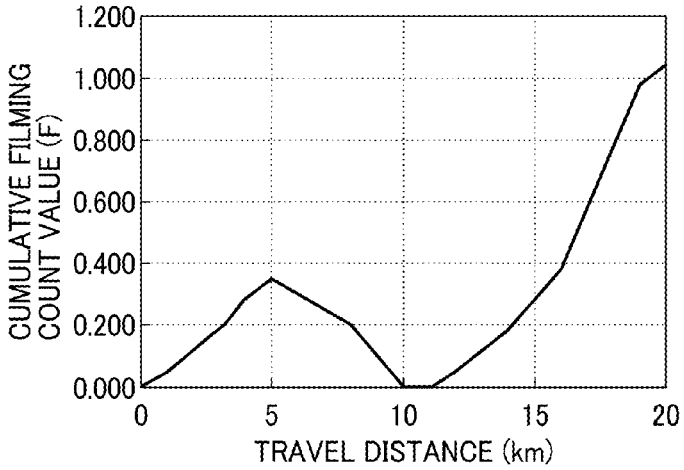
FIG. 7 is a graph illustrating the relationship between the travel distance and the cumulative filming count value (F) illustrated in the table of FIG. 6.
Figure 8:
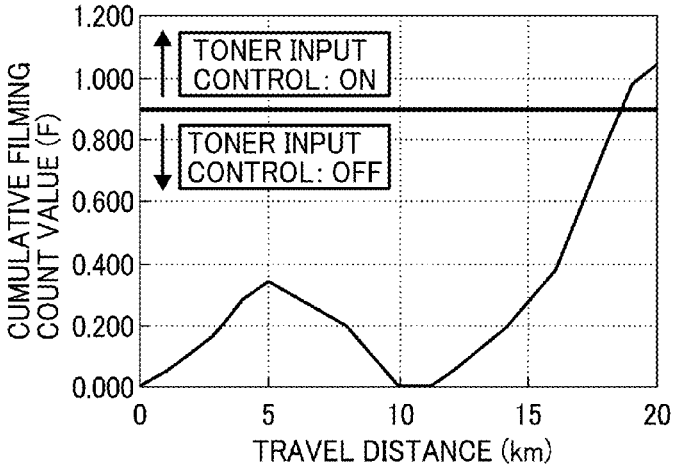
FIG. 8 is a schematic view illustrating an example of the strip-shaped toner pattern formation control.

FIG. 7 is a graph illustrating the relationship between the travel distance and the cumulative filming count value (F) illustrated in the table of FIG. 6.

The control part 600 performs a filming counting operation (i.e., calculation of the filming count value FC) whenever the travel distance of the photoconductor 2 increases. In this case, the control part 600 obtains information on the ambient temperature detected by the temperature sensor 602. The memory (such as ROM) of the control part 600 stores a table such as the table illustrated in FIG. 5, in which the relationship between the ambient temperature (i.e., range of environmental conditions A1-A7 in FIG. 5) and the correction coefficient Ai is illustrated. The control part 600 determines the range of environmental conditions A1-A7 based on the ambient temperature detected by the temperature sensor 602, and the table stored in the memory to determine the correction coefficient Ai. The control part 600 multiplies the travel distance by the correction coefficient Ai to determine a filming count value FC at the travel distance. The control part 600 performs this filming counting operation whenever the travel distance of the photoconductor 2 increases, and the filming count values FC are accumulated to determine the cumulative filming count value F. The data of the cumulative filming count value F are stored in the memory (such as RAM) of the control part 600. In the example illustrated in FIG. 6, whenever the travel distance increases by 1 km, the filming counting operation is performed. In this regard, the temperature illustrated in FIG. 6 means the average internal temperature in the image forming apparatus when the travel distance is from 0 to 1 km (i.e., (d)km to (d+1)km, wherein d is a positive integer). The filming counting operation is not limited thereto, and the filming counting operation may be performed whenever an image forming operation is ended.

It can be understood from the table illustrated in FIG. 6 that under low temperature conditions, the blade member 5A maintains high hardness and therefore the blade member has high film removing ability, thereby producing an effect of reducing the amount of film, resulting in decrease in the cumulative filming count value F. In contrast, under high temperature conditions, the cumulative filming count value F increases. Thus, the cumulative filming count value F increases or decreases (i.e., makes up-and-down motion). However, since many heat sources represented by the fixing unit 13 are present in the printer part 18 of the image forming apparatus, it is hard to maintain the image forming apparatus under low temperature conditions when image forming operations are continuously performed, and therefore it is hard to produce the filming reducing effect. Namely, the amount of film on the photoconductor 2 gradually increases.

In the image forming apparatus of this disclosure, when the cumulative count value F exceeds 1, the image quality tends to deteriorate (for example, white spots are formed in a half-tone image) due to the film formed on the photoconductor 2. Therefore, the control part 600 performs a control operation such that when the cumulative filming count value F exceed a predetermined value 0.9, the special toner image forming operation is performed to input a strip-shaped toner pattern to the blade member 5A. By performing this control operation, the amount of toner staying in the wedge-shaped gap H formed between the edge 5*e* and the surface of the photoconductor 2 can be increased, thereby enhancing the film removing (scratching off) effect, resulting in prevention of growth of the film on the photoconductor. As a result, the risk of deterioration of the image quality due to the film can be relatively reduced compared to a case in which the strip-shaped toner pattern is not input to the blade member 5A.

Figure 9:
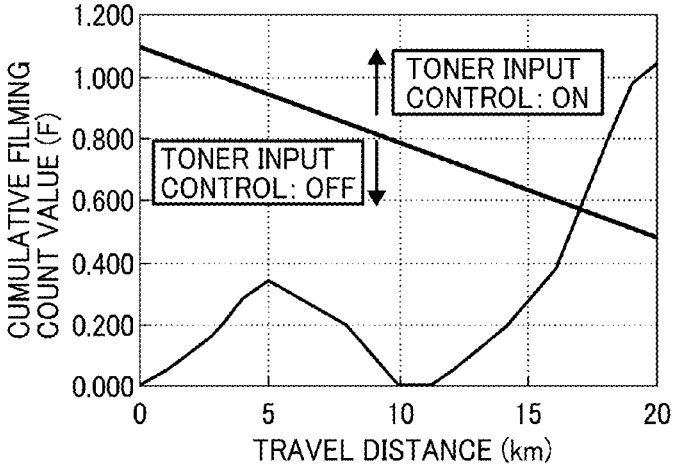
FIG. 9 is a schematic view illustrating another example of the strip-shaped toner pattern formation control.

In the above example, the predetermined upper limit value is fixed to 0.9. However, as illustrated in FIG. 9, the upper limit value may be changed as the travel distance increases. This is because at the initial stage the filming problem is hardly caused, but after repeated use the devices and members of the image forming apparatus deteriorate, and therefore the probability of occurrence of the filming problem increases. By using this method, the upper limit value can be set to a relatively high value at the initial stage, and therefore the number of the special toner image forming operation of forming the strip-shaped toner pattern can be reduced, thereby preventing increase in downtime of the image forming apparatus. In addition, by using this method, the upper limit value can be set to a relatively low value after repeated use, and therefore deterioration of the image quality due to the filming can be prevented more securely.

Figure 10:
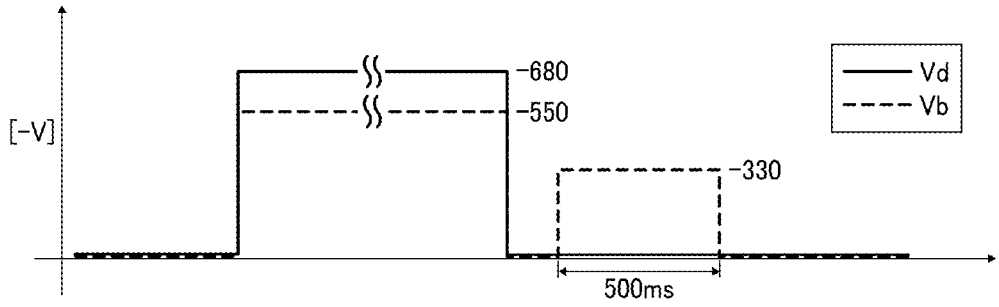
FIG. 10 is a schematic view illustrating a strip-shaped toner pattern forming operation in a control example 1.

FIG. 10 is a schematic view illustrating an example of the special toner image forming operation (i.e., the strip-shaped toner pattern forming operation). This control example is hereinafter referred to as control example 1.

In this control example 1, when the cumulative filming count value F exceeds the predetermined upper limit value, the execution flag of the strip-shaped toner pattern forming operation is set. When the execution flag is set, the strip-shaped toner pattern forming operation is performed after the image forming job is ended. Specifically, when the primary transfer operation for the last page of the image in the image forming job is ended, the charge bias Vd (−680V) is turned off while maintaining driving of the photoconductor and the intermediate transfer belt. When the position of the photoconductor at which the charge bias Vd (−680V) is turned off reaches the development region of the developing device 4, the development bias Vb (−550V) is turned off, followed by turning on the development bias Vb again after 100 ms, wherein the development bias Vb is set to −330V (−550×0.6).

In this case, the difference between the development bias (−330V) and the potential of the surface of the photoconductor 2 (about 0V because the charge bias is turned off) is the development potential, which is 60% of the development potential in the normal image forming operation, and therefore toner in an amount corresponding to the development potential (i.e., 60% of the development potential in the normal image forming operation) is supplied to the surface of the photoconductor 2 from the developing device 4.

When 500 milliseconds pass after the development bias Vb (−330V) is turned on, the development bias Vb is turned off again. Therefore, a strip-shaped toner pattern which has a length corresponding to the travel distance of the photoconductor per 500 ms and a width equal to the maximum length of the image forming area of the photoconductor in the axis direction thereof is formed on the surface of the photoconductor, and the strip-shaped toner pattern is input to the edge 5*e* of the blade member 5A. In this regard, if the primary transfer bias is turned off or the intermediate transfer belt 7 is separated from the photoconductor 2 so that the strip-shaped toner pattern is not transferred to the intermediate transfer belt, the toner image can be input to the edge 5*e* of the blade member 5A without waste. In this strip-shaped toner pattern forming operation, the development bias Vb and the application time of the development bias are not particularly limited, and are set to proper bias and application time.

By forming the strip-shaped toner pattern after ending an image forming job, the first print time can be decreased so as to be shorter than that in a case in which the strip-shaped toner pattern is formed before an image forming job. In addition, deterioration of the productivity of the image forming apparatus can be reduced compared to a case in which the strip-shaped toner pattern is formed between two images (copies) in an image forming job.

Figure 11:
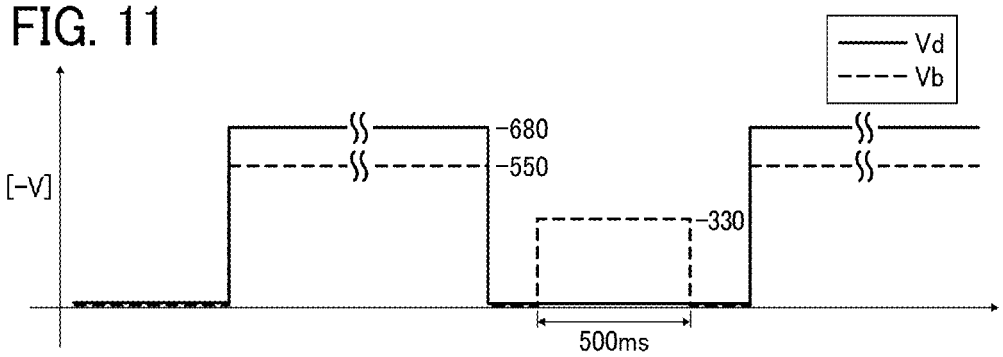
FIG. 11 is a schematic view illustrating a strip-shaped toner pattern forming operation in a control example 2.

FIG. 11 is a schematic view illustrating another example of the strip-shaped toner pattern forming operation. This control example is hereinafter referred to as control example 2.

In the control example 1 mentioned above, the strip-shaped toner pattern forming operation is performed at the end of an image forming job. However, in this control example 2, the strip-shaped toner pattern forming operation is performed in the middle of an image forming job. Specifically, when the cumulative filming count value F exceeds the predetermined upper limit value, and the execution flag of the strip-shaped toner pattern forming operation is set, the image forming operation is broken after the running image forming operation is ended. Next, similarly to the control example 1, the charge bias Vd is turned off without stopping driving of the photoconductor 2 and the intermediate transfer belt 7 so that the strip-shaped toner pattern is formed on the photoconductor using the difference between the development bias Vb and the potential of the photoconductor, and then the strip-shaped toner pattern is input to the edge 5*e* of the blade member 5A. After the strip-shaped toner pattern forming operation is performed, the rest of the image forming job (i.e., print of remaining images to be formed) is performed.

Figure 12:
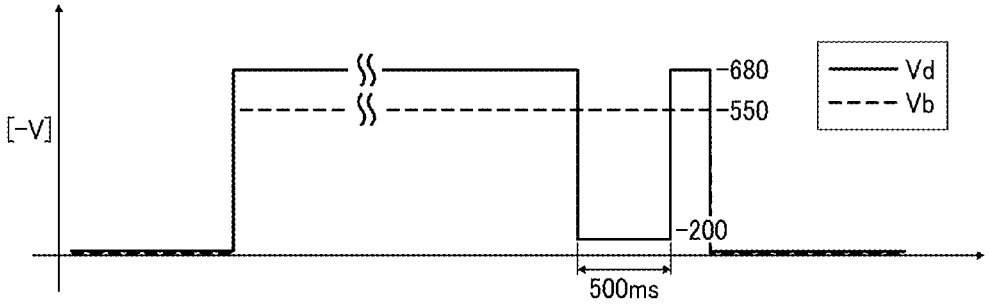
FIG. 12 is a schematic view illustrating a strip-shaped toner pattern forming operation in a control example 3.

FIG. 12 is a schematic view illustrating another example of the strip-shaped toner pattern forming operation. This control example is hereinafter referred to as control example 3.

In the control examples 1 and 2, it is necessary to apply a development bias different from that in the normal image forming operation to adjust the amount of toner to be supplied, and therefore the charge bias and the development bias have to be turned off once. In this control example 3, the strip-shaped toner pattern is formed by forming an electrostatic latent image of the strip-shaped toner pattern on the photoconductor 2 using the optical writing unit 6 without turning off the charge bias and the development bias.

Specifically, when the cumulative filming count value F exceeds the predetermined upper limit value, and the execution flag of the strip-shaped toner pattern forming operation is set, the optical writing unit 6 irradiates the entire surface of the photoconductor 2 with light for 500 ms without stopping driving of the photoconductor and the intermediate transfer belt and application of the charge bias and the development bias after the final image of the image forming job is primarily transferred to the intermediate transfer belt. In this regard, it is preferable to control the lighting time (or light amount) necessary for forming a 1-dot electrostatic latent image of the strip-shaped toner pattern so as to be, for example, 60% of the lighting time necessary for forming a 1-dot electrostatic latent image of a normal image to control the amount of toner of the strip-shaped toner pattern. However, setting of the lighting time (light amount) is not limited thereto.

Figure 13:
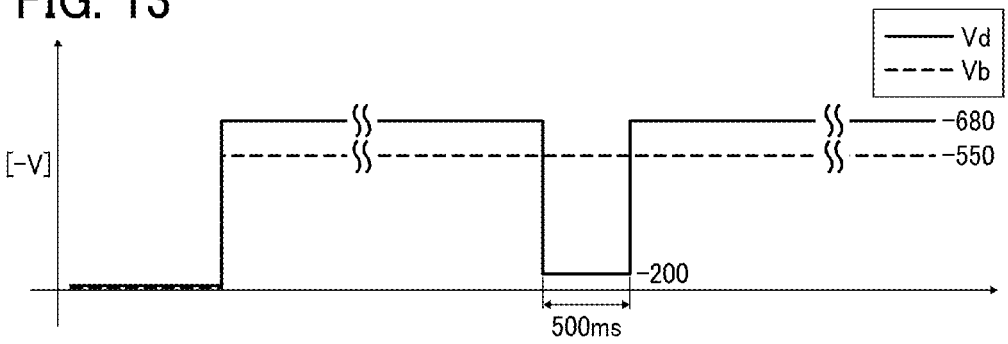
FIG. 13 is a schematic view illustrating a strip-shaped toner pattern forming operation in a control example 4.

FIG. 13 is a schematic view illustrating another example of the strip-shaped toner pattern forming operation. This control example is hereinafter referred to as control example 4.

In this control example 4, the latent image of the strip-shaped toner pattern is formed by the optical writing unit 6 similarly to the control example 3. However, the strip-shaped toner pattern is formed in the middle of an image forming job similarly to the control example 2.

The filming counting operation is not necessarily performed on each of the photoconductors 2Y, 2C, 2M and 2K, and can be performed on the photoconductor 2K and one of the photoconductors 2Y, 2C and 2M for forming color images. This is because when color images are formed in the image forming apparatus, the photoconductors 2Y, 2C and 2M are rotated at the same time while stopped at the same time, and therefore the travel distances of the photoconductors 2Y, 2C and 2M are the same. Therefore, the photoconductors 2Y, 2C and 2M have the same cumulative filming count value F, and it is not necessary to perform the film counting operation on each of the photoconductors. By using this method, the capacity of the memory of the controller can be reduced, thereby making it possible to reduce the costs of the image forming apparatus. In addition, the load on the CPU of the controller in calculation can also be reduced.

In contrast, only the photoconductor 2K is rotated when a monochromatic image (black and white image) is formed. Therefore, the travel distance of the photoconductor 2K is different from that of the photoconductors 2Y, 2C and 2M. Thus, the filming counting operation is performed on the photoconductor 1K independently of the other photoconductors, and therefore the filming counting operation can be performed on each of the photoconductor 2K and the other photoconductors 2Y, 2C and 2M at the most appropriate stage.

Figure 14:
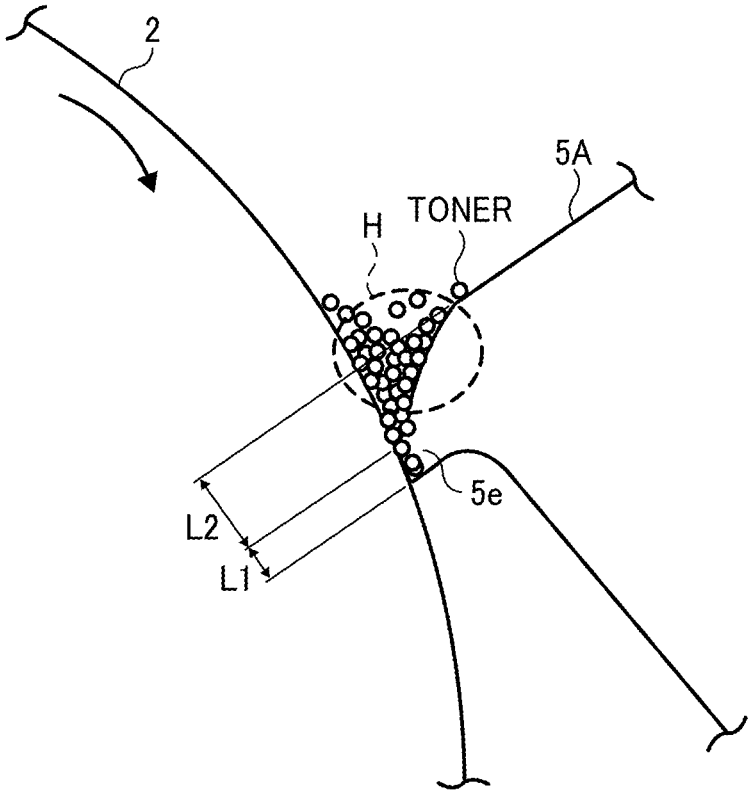
FIG. 14 is a schematic view illustrating the edge of the cleaning blade to which a strip-shaped toner pattern is input.

FIG. 14 is a schematic view illustrating the edge 5*e* of the blade member 5A to which a strip-shaped toner pattern is input.

The strip-shaped toner pattern input to the blade member 5A stays in the wedge-shaped gap H, which is formed by the blade member and the photoconductor 2 and which is present on the upstream side from the edge 5*e* relative to the moving direction of the photoconductor. In addition part of the toner is present at the nip formed between the blade member 5A and the surface of the photoconductor 2. The toner present at the nip eventually passes through the nip, but the toner hardly affects the image quality if the number of toner particles passing through the nip is small. However, when the number of toner particles present at the nip increases and the toner is accumulated and stays at the nip, a gap is formed between the edge 5*e* and the surface of the photoconductor 2, and therefore other toner particles easily pass through the nip, resulting in deterioration of the image quality. Therefore, in the image forming apparatus of this disclosure, the photoconductor 2 is inversely rotated at the end of an image forming job to remove the toner present at the nip (i.e., to prevent accumulation of the toner at the nip).

In the normal image forming operation, the toner input to the blade member 5A is residual toner remaining on the surface of the photoconductor 2 without being transferred. Therefore, the amount of the toner present in the wedge-shaped gap H is small. However, when the strip-shaped toner pattern forming operation is performed and a large amount of toner is input to the blade member 5A, a large amount of toner is present in the wedge-shaped gap H as illustrated in FIG. 14. In this case, a high pressure is applied to the toner in the wedge-shaped gap H. When the toner in the wedge-shaped gap H stays therein over a long period of time, there is a risk such that a film of the toner is formed on the surface of the photoconductor 2, thereby causing the filming problem. Particularly, in the control examples 1 and 3 mentioned above, in which the strip-shaped toner pattern is formed so as to be input to the blade member 5A after ending an image forming job, it is possible that a large amount of toner stays in the wedge-shaped gap H over a long period of time, and thereby the filming problem is caused.

As mentioned above, the image forming apparatus of this disclosure performs a toner removing operation such that the photoconductor 2 is inversely rotated after an image forming job to remove the toner at the nip formed between the edge 5*e* and the surface of the photoconductor 2. By performing the toner removing operation, the toner staying in the wedge-shaped gap H is released from the wedge-shaped gap H as the photoconductor is inversely rotated. Therefore, the pressure applied to the toner in the wedge-shaped gap H is considered to be decreased. However, in reality, the amount of rotation of the photoconductor in the toner removing operation is too small to satisfactorily decrease the pressure to the toner in the wedge-shaped gap H, and when the toner allowed to settle over a long period of time, the filming problem is caused.

Figure 18:
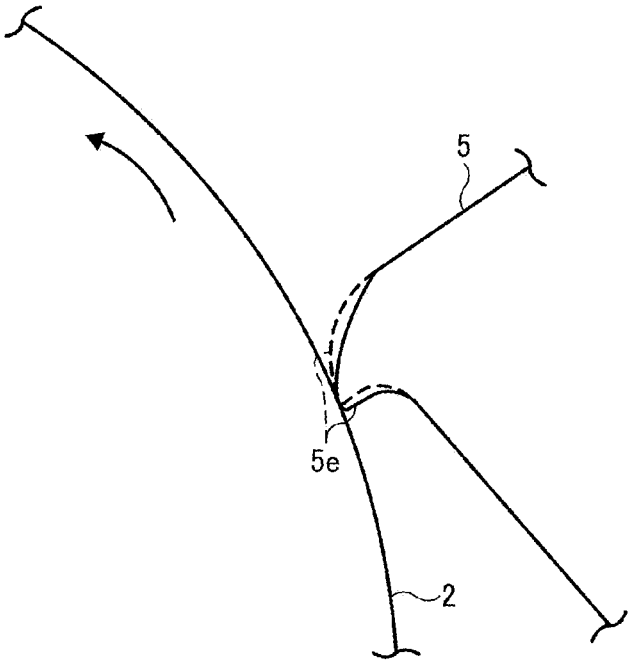
FIG. 18 is a schematic view illustrating the edge of the cleaning blade when the photoconductor is inversely rotated.

The present inventors consider that the reason therefor is as follows. Specifically, as illustrated in FIG. 14, the edge 5*e* of the blade member 5A is pressed toward the downstream side relative to the moving direction of the photoconductor 2 due to the frictional force between the blade member and the photoconductor, and the pressure of the toner in the wedge-shaped gap H. In this case, when the photoconductor 2 is inversely rotated, the edge 5*e* is moved in the inverse rotation direction of the photoconductor (i.e., a direction opposite to the direction indicated by an arrow in FIG. 14) due to the frictional force between the blade member and the photoconductor. In addition, the surface of the tip portion of the blade member 5A is also moved in the inverse rotation direction of the photoconductor. Therefore, after the photoconductor 2 is inversely rotated, the edge 5*e* of the blade member 5A has such a posture as illustrated by a dotted line in FIG. 18. The travel distance of the edge 5*e* is relatively short compared to that of the photoconductor 2 in the toner removing operation (i.e., inverse rotation operation) because the edge slightly slips on the surface of the photoconductor. Specifically, the travel distance of the photoconductor 2 in the toner removing operation is L1 as illustrated in FIG. 14, which is relatively short and which is equal to the length of the contact portion between the edge 5*e* and the surface of the photoconductor. However, inverse rotation of the photoconductor with the travel distance L1 is sufficient for removing the toner at the nip between the edge 5*e* and the surface of the photoconductor. Thus, the travel distance of the edge 5*e* relative to the photoconductor 2 is very short, and therefore the toner staying in the wedge-shaped gap H is hardly released therefrom in the toner removing operation. Therefore, the high pressure continues to be applied to the toner in the wedge-shaped gap H even when the toner removing operation is performed, and thereby occurrence of the filming problem cannot be prevented by the toner removing operation.

Therefore, in the image forming apparatus of this disclosure, when the strip-shaped toner pattern is input to the blade member 5A, an inverse rotation operation in which the photoconductor 2 is inversely rotated with a length longer than that in the toner removing operation mentioned above. By performing this inverse rotation operation, the pressure applied to the toner staying in the wedge-shaped gap H can be sufficiently decreased, thereby making it possible to prevent occurrence of the filming problem even when the image forming apparatus is allowed to settle over a long period of time. The proper travel distance of the photoconductor 2 in this inverse rotation operation depends on the configuration, the constitutional material, and the layout of the cleaning blade, and cannot be unambiguously determined. However, the travel distance should be longer than the distance L1 (illustrated in FIG. 14) in the toner removing operation to decrease the pressure applied to the toner staying in the wedge-shaped gap H in an amount greater than that in the toner removing operation, resulting in prevention of occurrence of the filming problem. In this regard, the toner once released from the wedge-shaped gap H by the inverse rotation operation is input again to the blade member 5A in the next normal image forming operation, and therefore the amount of toner staying at the edge 5*e* can be increased, thereby producing the film removing effect.

When the strip-shaped toner pattern is not formed (i.e., when only the normal image forming operation is performed), the photoconductor 2 is inversely rotated with the length L1 so that at least the toner present at the nip between the edge 5*e* and the surface of the photoconductor is removed therefrom. The blade member 5A and the charging roller 3*a*, which are contacted with the photoconductor 2, are designed such that when they are rotated in the normal direction, they achieve the optimal state. Therefore, when the blade member 5A and the charging roller 3*a* are inversely rotated with a long length, they are subjected to abnormal mechanical load, resulting in deterioration of the blade member and the charging roller. Therefore, it is preferable that when the strip-shaped toner pattern is not input to the blade member 5A, the photoconductor 2 is inversely rotated with a minimum length necessary for removing the toner at the nip between the edge 5*e* and the surface of the photoconductor 2 to prevent the members contacted with the photoconductor 2 from receiving an abnormal mechanical load.

Figure 15:
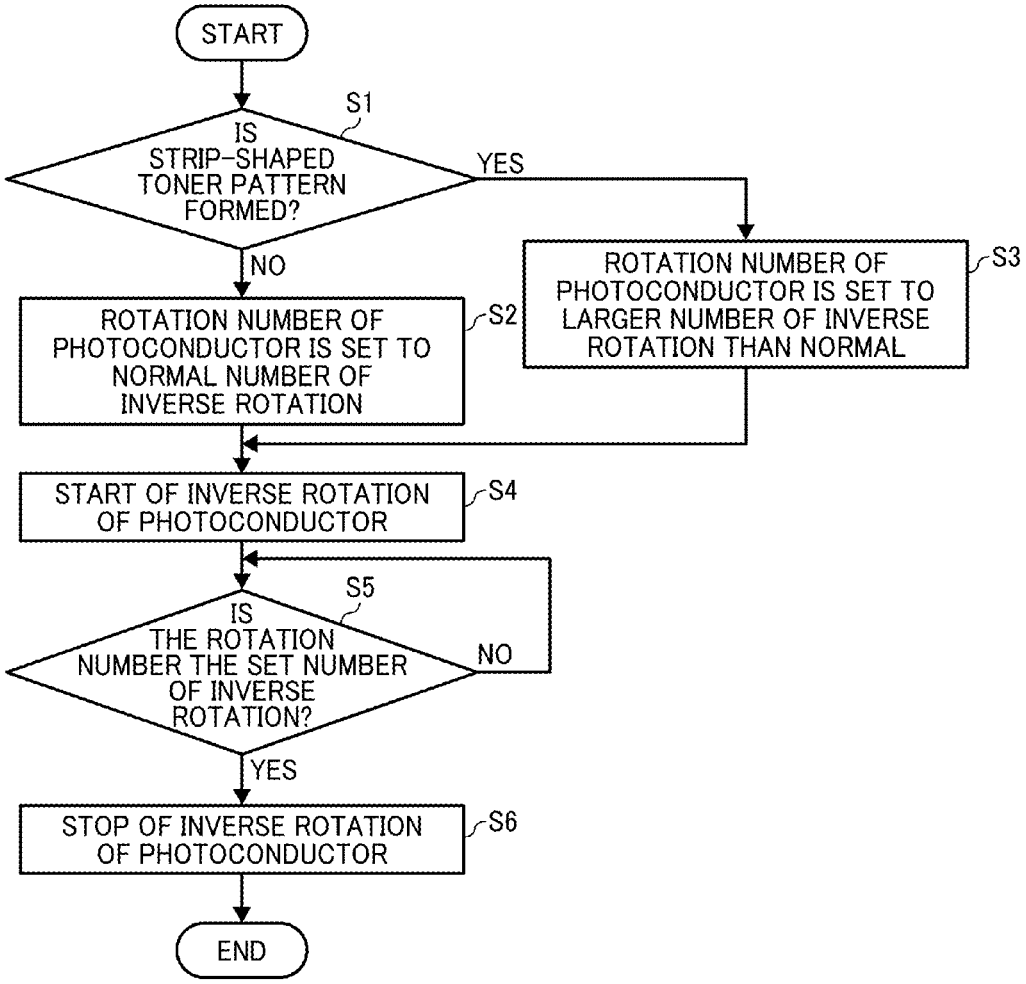
FIG. 15 is a control flow diagram illustrating the inverse rotation operation of the photoconductor.

FIG. 15 is a control flow diagram illustrating the inverse rotation operation of the photoconductor.

Referring to FIG. 15, when an image forming job is ended, the controller checks whether the strip-shaped toner pattern forming operation is performed (step S1). When the strip-shaped toner pattern is not formed (No in step S1), the photoconductor is placed in the toner removing mode (step S2) because a large amount of toner does not stay in the wedge-shaped gap H and the toner is not pressed. When the photoconductor 2 is stopped, inverse rotation of the photoconductor is started (step S4). When the photoconductor 2 is inversely rotated with the length L1, which is equal to the length of the contact portion of the edge 5*e* with the photoconductor (Yes in step S5), the inverse rotation of the photoconductor is stopped (step S6).

When the strip-shaped toner pattern is formed (Yes in step S1), the photoconductor 2 is placed in the inverse rotation mode (step S3) because a large amount of toner stays in the wedge-shaped gap H and therefore there is a risk such that the filming problem is caused. When the photoconductor 2 is stopped, inverse rotation of the photoconductor is started (step S4). When the photoconductor 2 is inversely rotated with the predetermined length longer than the length L1 in the toner removing mode (Yes in step S5), the inverse rotation of the photoconductor is stopped (step S6).

Next, the verification experiments that the present inventors performed will be described.

(Verification Experiment 1)

In the verification experiment 1, the following two machines of the image forming apparatus having such a configuration as illustrated in FIG. 1 were used.

1. Machine A

In the machine A, in which the length L1 in the toner removing operation was set to 1 mm, after the strip-shaped toner pattern was formed and input to the blade member, the photoconductor was inversely rotated with a length of 2 mm. The machine A was then allowed to settle for 3 days under environmental conditions of 27° C. and 80% RH.

2. Machine B

In the machine B, in which the length L1 in the toner removing operation was also set to 1 mm similarly to the machine A, after the strip-shaped toner pattern was formed and input to the blade member, the photoconductor was inversely rotated with a length of 1 mm. The machine B was then allowed to settle for 3 days under environmental conditions of 27° C. and 80% RH.

As a result, in the machine B, a minor toner streak was fixed to the surface of the photoconductor, which surface forms the wedge-shaped gap H, but such a toner streak was not formed on the photoconductor of the machine A.

(Verification Experiment 2)

In the verification experiment 2, the following three machines of the image forming apparatus having such a configuration as illustrated in FIG. 1 were used.

1. Machine C

In the machine C, in which the length L1 in the toner removing operation was set to 0.7 mm, after the strip-shaped toner pattern was formed and input to the blade member, the photoconductor was inversely rotated with a length of 1.7 mm. The machine C was then allowed to settle for 3 days under environmental conditions of 27° C. and 80% RH.

2. Machine D

In the machine D, in which the length L1 in the toner removing operation was set to 0.7 mm, after the strip-shaped toner pattern was formed and input to the blade member, the photoconductor was inversely rotated with a length of 1 mm. The machine D was then allowed to settle for 3 days under environmental conditions of 27° C. and 80% RH.

3. Machine E

In the machine E, in which the length L1 in the toner removing operation was set to 0.7 mm, after the strip-shaped toner pattern was formed and input to the blade member, the photoconductor was inversely rotated with a length of 0.7 mm. The machine E was then allowed to settle for 3 days under environmental conditions of 27° C. and 80% RH.

As a result, adherence of toner to the surface of the photoconductor was not observed in the machine C, in which the photoconductor was inversely rotated with a length of 1.7 mm, which is 1 mm longer than the length (0.7 mm) in the toner removing operation. In contrast, adherence of toner to the surface of the photoconductor was observed in the machine D, in which the photoconductor was inversely rotated with a length of 1 mm, which is 0.3 mm longer than the length (0.7 mm) in the toner removing operation, and the machine E, in which the photoconductor was inversely rotated with a length of 0.7 mm, which is the same as the length (0.7 mm) in the toner removing operation. In this regard, the amount of the toner adhered to the photoconductor in the machine E was greater than that in the machine D. It can be understood from the verification experiment 2 that as the photoconductor is inversely rotated with a length greater than that in the toner removing operation, the pressure to the toner staying in the wedge-shaped gap H can be reduced more effectively, and therefore the toner film preventing effect can be produced more effectively.

In the above description, when a strip-shaped toner pattern is input to the blade member 5A, the photoconductor is inversely rotated with a length longer than that in the toner removing operation. In a case in which jamming of the recording medium S occurs in the normal image forming apparatus, a toner image to be transferred to the intermediate transfer belt 7 is input to the blade member 5A. In this case, a large amount of toner stays in the wedge-shaped gap H after the image forming job. Therefore, in this case, it is preferable that the photoconductor is inversely rotated with a length greater than that in the toner removing operation (similarly to the inverse rotation operation mentioned above) to prevent occurrence of the filming problem even when the image forming apparatus is allowed to settle over a long period of time thereafter.

Next, an example of the toner which has a good combination of low temperature fixability, high temperature preservability, transferability and filming resistance even when being used over a long period of time and which can be preferably used for the image forming apparatus of this disclosure will be described.

The toner includes toner particles (i.e., mother toner) and an external additive, and optionally includes other components if necessary.

(External Additive)

The external additive is not particularly limited as long as the external additive includes united (aggregated) particles.

<United Particles>

The united particles means secondary particles in which primary particles are adhered to each other and which have a non-spherical form.

The external additive includes at least such united particles (secondary particles) as mentioned above, and can include primary particles of the external additive.

<<Primary Particle>>

The external additive is not particularly limited, and a proper material is used as the external additive depending on the purpose of the toner. Specific examples of the material for use as the external additive include particulate inorganic materials such as silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide and silicon nitride; and particulate organic materials. These can be used alone or in combination. Among these materials, silica is preferable because silica hardly causes problems such that the external additive is buried in or released from the toner particles.

The volume average particle diameter (Da) of primary particles of the external additive is not particularly limited, but is preferably from 20 nm to 150 nm, and more preferably from 35 nm to 150 nm. When the volume average particle diameter is less than 20 nm, a spacer effect of the external additive cannot be satisfactorily produced, and therefore a problem in that the external additive is buried in the toner particles tends to be caused when an external stress is applied to the toner. In contrast, when the volume average particle diameter is greater than 150 nm, the external additive is easily released from the toner particles, and therefore the filming problem tends to be caused.

The volume average particle diameter (Da) of primary particles of an external additive constituting secondary particles is determined by measuring the particle diameter (indicated by arrows in FIG. 16) of each of primary particles constituting secondary particles. Specifically, the external additive including secondary particles is dispersed in a proper solvent (such as tetrahydrofuran (THF)). The dispersion liquid is applied on a substrate, and the dispersion liquid is dried to prepare a sample. The sample is observed with a field emission type scanning electron microscope (FE-SEM) under conditions of 5 to 8 kV in acceleration voltage, and 8,000 to 10,000 in power magnification, and the diameters of the primary particles constituting secondary particles in the field of view are measured. In this regard, the particle diameter of a primary particle means the maximum diameter of the particle as illustrated by the arrow in FIG. 16. The particle diameters of 20 to 100 primary particles are averaged to determine the volume average particle diameter (Da) of primary particles of the external additive.

<<Secondary Particle>>

Next, the secondary particles will be described. The secondary particles mean the united particles mentioned above.

Such secondary particles can be prepared, for example, by subjecting primary particles with such a treatment agent as mentioned above so that the primary particles are aggregated (i.e., secondary aggregation) due to formation of chemical bond. Among various secondary particles, sol-gel silica is preferable.

The volume average particle diameter (Db) of such secondary particles is not particularly limited, and is preferably from 80 nm to 200 nm, more preferably from 100 nm to 180 nm, and even more preferably from 100 nm to 160 nm. When the volume average particle diameter is less than 80 nm, a spacer effect of the external additive cannot be satisfactorily produced, and therefore a problem in that the external additive is buried in the toner particles tends to be caused when an external stress is applied to the toner. In contrast, when the volume average particle diameter is greater than 200 nm, the external additive is easily released from the toner particles, and therefore the filming problem tends to be caused.

The method for determining the volume average particle diameter (Db) of the secondary particles (united particles) of an external additive is the following. Specifically, the external additive including secondary particles is dispersed in a proper solvent (such as tetrahydrofuran (THF)). The dispersion liquid is applied on a substrate, and the dispersion liquid is dried to prepare a sample. The sample is observed with a field emission type scanning electron microscope (FE-SEM) under conditions of 5 to 8 kV in acceleration voltage, and 8,000 to 10,000 in power magnification, and the diameters of the secondary particles (united particles) in the field of view are measured. In this regard, the particle diameter of a secondary particle means the maximum diameter of the secondary particle (united particles) (i.e., the diameter indicated by the arrow in FIG. 17). In this regard, the particle diameters of 100 to 200 secondary particles are averaged to determine the volume average particle diameter (Da) of secondary particles of the external additive.

<<Uniting Degree of United Particles>>

The uniting degree (G) of an external additive is represented by the following equation:

$$G=Db/Da,$$

wherein Db represents the volume average particle diameter of secondary (united) particles, and Da represents the volume average particle diameter of primary particles constituting the secondary particles. The volume average particle diameters of secondary particles and the primary particles can be determined by the method mentioned above.

The uniting degree of the united particles of the external additive used for the toner is not particularly limited, and is preferably from 1.5 to 4.0, and more preferably from 2.0 to 3.0. When the uniting degree is less than 1.5, the external additive tends to enter into recessed portions of surface of the toner particles, and therefore the external additive tends to be buried in the toner particles, resulting in deterioration of the transferring property of the toner. In contrast, when the uniting degree is greater than 4.0, the external additive tends to be easily released from the toner particles, thereby causing problems such that the carrier is contaminated by the external additive, and the surface of the photoconductor is damaged by the external additive when the developer is used over a long period of time.

The ratio of united particles having a uniting degree of less than 1.3 in the united particles is not particularly limited, but is preferably not greater than 10% by number. The uniting degree of united particles has a distribution due to manufacturing variation. United particles having a uniting degree of less than 1.3 are particles in which uniting hardly progresses and which have substantially spherical forms. Since united particles having irregular forms are preferable because the united particles have good abrading ability and toner removing ability, the united particles having a uniting degree of less than 1.3 hardly produce the effects.

The method for measuring the ratio of united particles having a uniting degree of less than 1.3 is the following. Specifically, initially, the volume average particle diameters Da and Db of 100 to 200 primary particles and secondary particles are measured, and the uniting degree of each of the secondary particles is calculated, followed by calculating the ratio of the number of secondary (united) particles having a uniting degree of less than 1.3 to the number of all the secondary particles.

<<Particle Diameter Distribution Index of United Particles>>

In this application, the ratio Db50/Db10 is used as the particle diameter distribution index of united particles, wherein Db50 represents the 50% cumulative particle diameter (in units of nm) of the united particles, and Db10 represents the 10% cumulative particle diameter (in units of nm) of the united particles. Specifically, a graph (particle diameter distribution curve) in which the particle diameter (nm) of the united particles is plotted on the horizontal axis and the cumulative value (% by number) of the united particles is plotted on the vertical axis is drawn. Db10 represents the particle diameter at which the cumulative value of the united particles is 10% by number, and Db50 represents the particle diameter at which the cumulative value of the united particles is 50% by number.

The particle diameter distribution index Db50/Db10 preferably satisfies the following equation (1):

$$Db50/Db10 \leq 1.20 \quad (1).$$

When the particle diameter distribution index Db50/Db10 satisfies equation (1), the toner hardly causes the filming problem. Namely, when the particle diameter distribution index Db50/Db10 satisfies equation (1), the united particles have a sharp particle diameter distribution, and therefore the toner including the united particles of the external additive has good filming resistance.

Specifically, when particle diameters of 200 united particles are measured, the $100^{th}$ particle diameter from the minimum particle diameter is the Db50. If particle diameters of 150 united particles are measured, the $75^{th}$ particle diameter from the minimum particle diameter is the Db50.

The method for measuring the 50% cumulative particle diameter Db50 is the following. Specifically, the external additive including secondary particles is dispersed in a proper solvent (such as tetrahydrofuran (THF)). The dispersion liquid is applied on a substrate, and the dispersion liquid is dried to prepare a sample. The sample is observed with a field emission type scanning electron microscope (FE-SEM) under conditions of 5 to 8 kV in acceleration voltage, and 8,000 to 10,000 in power magnification, and the diameters of the secondary (united) particles in the field of view are measured. The 50% cumulative particle diameter Db50 of the united particles is determined by the method mentioned above. In this regard, the particle diameter of a united particle is the diameter illustrated by the arrow in FIG. 17, and the number of united particles to be observed by the FE-SEM is from 100 to 200.

As mentioned above, the 10% cumulative particle diameter Db10 can be determined from a particle diameter distribution curve in which the particle diameter (nm) of the united particles is plotted on the horizontal axis and the cumulative value (% by number) of the united particles is plotted on the vertical axis. When particle diameters of 200 united particles are measured, the $20^{th}$ particle diameter from the minimum particle diameter is the Db10. If particle diameters of 150 united particles are measured, the $15^{th}$ particle diameter from the minimum particle diameter is the Db10.

The method for measuring the 10% cumulative particle diameter Db10 is the following. Specifically, the external additive including secondary particles is dispersed in a proper solvent (such as tetrahydrofuran (THF)). The dispersion liquid is applied on a substrate, and the dispersion liquid is dried to prepare a sample. The sample is observed with a field emission type scanning electron microscope (FE-SEM) under conditions of 5 to 8 kV in acceleration voltage, and 8,000 to 10,000 in power magnification, and the diameters of the secondary (united) particles in the field of view are measured. The 10% cumulative particle diameter Db10 of the united particles is determined by the method mentioned above. In this regard, the particle diameter of a united particle is the diameter illustrated by the arrow in FIG. 17, and the number of united particles to be observed by the FE-SEM is from 100 to 200.

The particle diameter distribution index Db50/Db10 is not particularly limited as long as the index is not greater than 1.2, but is preferably not greater than 1.15. When the particle diameter distribution index Db50/Db10 is greater than 1.2, the united particles have a relatively wide particle diameter distribution, and the amount of particles having a small particle diameter increases. Specifically, small particles A, which are not united particles and which are primary particles, and/or small particles B, which are united particles constituted of small primary particles, are included in the external additive in a large amount. When the small particles A are included in a large amount, the external additive does not have desired irregular forms, and therefore the external additive cannot satisfactorily serve the function thereof. Therefore, the external additive tends to be buried in the toner, and thereby abnormal images are often formed. When the small particles B are included in a large amount, the external additive cannot produce the spacer function, and the external additive tends to be buried in the toner particles. Therefore, it is preferable to decrease the amount of the small particles A and the small particles B.

The method for decreasing the amount of the small particles A and the small particles B is not particularly limited, and for example classification methods for removing small particles can be used.

<<Shape of United Particles>>

Figure 16:
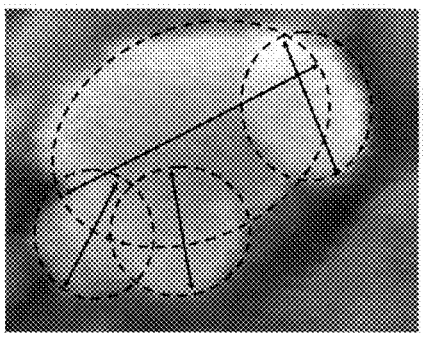
FIG. 16 is a photograph illustrating a united particle (i.e., secondary particle) of primary particles of an external additive of a toner.
Figure 17:
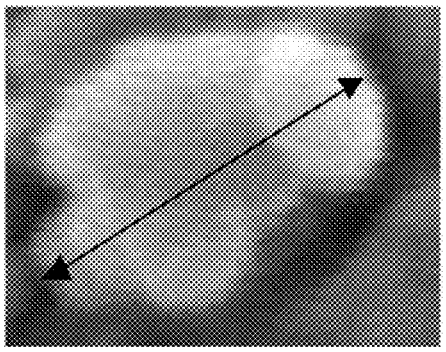
FIG. 17 is a photograph for use in determining the particle diameter of the united particle illustrated in FIG. 16.

The shape of the united particles is not particularly limited as long as the united particles have a non-spherical shape. Specific examples of the shape include such a non-spherical shape of united particles as illustrated in FIGS. 16 and 17, in which two or more particles are united. By using such united particles, high flowability can be imparted to the toner, and therefore, even when the toner is subjected to a load by being agitated in a developing device, the external additive is hardly buried in or rolled on the toner particles, thereby making it possible for the toner to maintain high transferability over a long period of time. In addition, since the united particles can maintain cohesive force (uniting force) between particles even under the predetermined agitating conditions, the toner has good durability.

The method for confirming whether particles are united is not particularly limited, but a method including observing the particles with a field emission type scanning electron microscope (FE-SEM) can be preferably used.

<<Method for Preparing United Particles>>

The method for preparing united particles is not particularly limited, but sol-gel methods can be preferably used. Specifically, methods, in which primary particles of an external additive and a treatment agent (mentioned below) are mixed or calcined so that the particles are chemically bonded with the treatment agent, and the particles are aggregated (secondary aggregation), thereby forming united particles (secondary particles), are preferable. In this regard, when united particles are synthesized by the sol-gel methods, it is possible to produce the united particles by performing a one-step reaction on a combination of primary particles and a treatment agent.

<<Treatment Agent>>

The treatment agent is not particularly limited, and for example silane type treatment agents and epoxy type treatment agents can be used alone or in combination. When silica is used as the primary particle of the external additive, silane type treatment agents are preferable because the Si—O—Si bond formed by silica and a silane type treatment agent is more stable to heat than the Si—O—C bond formed by silica and an epoxy type treatment agent. If desired, an auxiliary treatment agent such as water and 1% by weight aqueous solution of acetic acid may be used.

<<<Silane Type Treatment Agents>>>

The silane type treatment agent used for forming the united particles is not particularly limited. Specific examples of the silane type treatment agent include alkoxysilane compounds such as tetramethoxysilane, tetraethoxysilane, methyltrimethoxysilane, methyltriethoxysilane, dimethyldimethoxysilane, dimethyldiethoxysilane, methyldimethoxysilane, methyldiethoxysilane, diphenyldimethoxysilane, isobutyltrimethoxysilane, and decyltrimethoxysilane; silane coupling agents such as γ-aminopropyltriethoxysilane, γ-glycidoxypropyltrimethoxysilane, γ-glycidoxypropylmethyldiethoxysilane, γ-methacryloxypropyltrimethoxysilane, γ-mercaptopropyltrimethoxysilane, vinyltriethoxysilane, and methylvinyldimethoxysilane; other silane compounds such as vinyltrichlorosilane, dimethyldichlorosilane, methylvinyldichlorosilane, methylphenyldichlorosilane, phenyltrichlorosilane, N,N"-bis(tirmethylsilyl)acetamide, dimethyltrimethylsilylamine, hexamethyldisilazane, and cyclic silazane; etc. These compounds can be used alone or in combination.

Such silane type treatment agents can subject primary particles of an external additive (such as silica) to chemical bonding, thereby aggregating the primary particles (secondary aggregation).

When an alkoxysilane compound and/or a silane coupling agent is used as the silane type treatment agent for treating primary particles of silica, the silanol group of silica is reacted with the alkoxy group of the silane type treatment agent as illustrated in the following formula (A):

—Si—OH+RO—Si—→—Si—O—Si—+ROH formula (A), wherein R represents an alkyl group.

Namely, as a result of the reaction, a new Si—O—Si bond is formed while dealcoholizing, thereby aggregating the primary particles of silica.

When a chlorosilane compound is used as the treatment agent, the chlorine atom of the chlorosilane compound and the silanol group of silica are subjected to a dehydrochlorination reaction, thereby forming a Si—O—Si bond including a silanol group. The silanol group then makes a dehydration reaction, and thereby a new Si—O—Si bond is formed, resulting in aggregation of the primary particles of silica.

When a chlorosilane compound is used as the treatment agent for treating primary particles of silica and in addition water is present in the reaction system, initially the chlorosilane compound is hydrolyzed by water, thereby forming a silanol group. The silanol group is reacted with a silanol group of silica (dehydration reaction), and thereby a new Si—O—Si bond is formed, resulting in aggregation of primary particles of silica.

When a silazane compound is used as the treatment agent, the amino group of the silazane compound is reacted with a silanol group of silica (deammoniation reaction), and thereby a new Si—O—Si bond is formed, resulting in aggregation of primary particles of silica.

<<<Epoxy Type Treatment Agent>>>

The epoxy type treatment agent used for forming the united particles is not particularly limited. Specific examples of the epoxy type treatment agent include bisphenol A type epoxy resins, bisphenol F type epoxy resins, phenol novolac type epoxy resins, cresol novolac type epoxy resins, bisphenol A novolac type epoxy resins, bisphenol type epoxy resins, glycidylamine type epoxy resins, alicyclic type epoxy resins, etc.

When such epoxy type treatment agents are used for treating primary particles of silica, the treatment agent is chemically bonded with the primary particles as illustrated by the following formula (B):

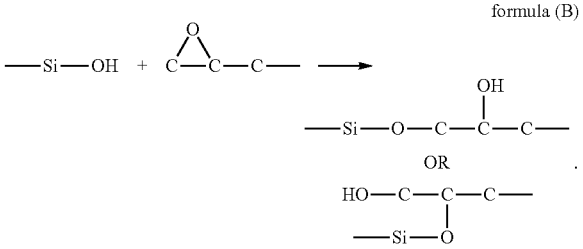

formula (B)

Specifically, a silanol group of primary particles of silica is reacted with the carbon atom of an epoxy group of the epoxy type treatment agent, and a new Si—O—C bond is formed, thereby aggregating the primary particles of silica (secondary aggregation).

The weight ratio (P/T) of primary particles of an external (P) to a treatment agent (T) is not particularly limited, and is preferably from 100/0.01 to 100/50. In this regard, as the added amount of the treatment agent increases, the uniting degree of the primary particles tends to increase.

The method for mixing a treatment agent and primary particles of an external additive is not particularly limited, and for example methods using a mixer (such as spray driers) can be used. In this regard, methods in which after primary particles are prepared, the primary particles are mixed with a treatment agent, or methods in which primary particles are prepared in the presence of a treatment agent (i.e., one-step reaction) can be used.

The calcination temperature at which the treatment agent and primary particles are calcined is not particularly limited, but is preferably from 100° C. to 2,500° C. In this regard, as the calcination temperature increases, the uniting degree of the primary particles tends to increase.

The calcination time for which the treatment agent and primary particles are calcined is not particularly limited, but is preferably from 0.5 hr to 30 hr.

The added amount of an external additive is not particularly limited, but is preferably from 0.5 to 4.0 parts by weight based on 100 parts by weight of toner particles (i.e., mother toner).

(Toner Particles (Mother Toner))

The toner particles include at least a binder resin and a colorant.

<Binder Resin>

The binder resin of the toner particles is not particularly limited, and a proper resin is chosen and used in consideration of the purpose of the toner. Specific example of the binder resin include polyester resins, silicone resins, styrene-acrylic resins, styrene resins, acrylic resins, epoxy resins, diene resins, phenolic resins, terpene resins, coumarin resins, amide-imide resins, butyral resins, urethane resins, ethylene-vinyl acetate resins, etc. These can be used alone or in combination. Among these resins, polyester resins and combinations of a polyester resin and another of the resins mentioned above are preferable.

<<Polyester Resin>>

The polyester resin is not particularly limited, and a proper polyester resin is chosen and used. Among polyester resins, combinations of an unmodified polyester resin and a modified polyester resin can be preferably used. In this regard, it is preferable that the unmodified polyester resin and the modified polyester resin are partially or entirely dissolved in each other. Therefore, it is preferably that the unmodified polyester resin and the modified polyester resin are similar in composition.

<<<Unmodified Polyester Resin>>>

The unmodified polyester resin is not particularly limited, and a proper unmodified polyester resin is chosen and used in consideration of the purpose of the toner. For example, unmodified crystalline polyester resins and unmodified non-crystalline polyester resins can be used.

The acid value of the unmodified polyester resin is not particularly limited, but is preferably from 1 to 50 mgKOH/g, and more preferably from 5 to 30 mgKOH/g. When the acid value is greater than 50 mgKOH/g, the charge stability of the toner tends to deteriorate particularly when the environmental conditions vary. In contrast, when the acid value falls in the preferable range mentioned above, the toner has good charge stability, and in addition the toner has good affinity to paper in the fixing process, resulting in enhancement of the low temperature fixability of the toner.

The hydroxyl value of the unmodified polyester resin is not particularly limited, but is preferably not less than 5 mgKOH/g. The hydroxyl value can be measured by the method described in JIS K0070-1996.

Specifically, 0.5 g of a sample is precisely weighed in a 100 ml measuring flask, and 5 ml of an acetylating agent is added thereto. Next, the flask is heated for 1 to 2 hours in a hot bath heated to 100±5° C., and the flask is then taken out of the hot bath to be cooled. Further, water is added to the flask, and the mixture is shaken to decompose acetic anhydride. Next, in order to perfectly decompose acetic anhydride, the flask is heated in a hot bath for 10 minutes or more, followed by cooling, and the inner wall of the flask is washed with an organic solvent. Further, by using a potentiometric automatic titrator DL-53 and an electrode DG113-SC, which are from METTLER TOLEDO International Inc., the hydroxyl value is measured at 23° C., followed by analysis using analysis software LABX LIGHT VERSION 1.00.000. When performing calibration on the instrument, a mixture solvent of 120 ml of toluene and 30 ml of ethanol is used. In this regard, the measuring conditions are illustrated in Table 1 below.

TABLE 1

| |
|---|
| Stir |
| Speed: 25% |
| Time: 15 s |
| EQP titration |
| Titrant/Sensor |
| Titrant: $CH_3ONa$ |
| Concentration: 0.1 mole/l |
| Sensor: DG115 |
| Unit of measurement: mV |
| Predispensing to volume |
| Volume: 1.0 ml |
| Wait time: 0 s |
| Titrant addition: Dynamic |
| dE (set): 8.0 mV |
| dV (min): 0.03 ml |
| dV (max): 0.5 ml |
| Measure mode: Equilibrium controlled |
| dE: 0.5 mV |
| dt: 1.0 s |
| t (min): 2.0 s |
| t (max): 20.0 s |
| Recognition |
| Threshold: 100.0 |
| Steepest jump only: No |
| Range: No |
| Tendency: None |

TABLE 1-continued

| |
|---|
| Termination |
| at maximum volume: 10.0 ml |
| at potential: No |
| at slope: No |
| after number EQPs: Yes |
| n = 1 |
| comb. Termination conditions: No |
| Evaluation |
| Procedure: Standard |
| Potential 1: No |
| Potential 2: No |
| Stop for reevaluation: No |

<<<Method for Synthesizing Unmodified Polyester Resin>>>

The method for synthesizing the unmodified polyester resin is not particularly limited, and for example a method in which a polyol having the below-mentioned formula (1) and a polycalboxylic acid having the below-mentioned formula (2) are reacted can be used.

$$A\text{-}[OH]_m \qquad \text{formula (1)}$$

$$B\text{—}[COOH]_n \qquad \text{formula (2)}$$

In formula (1), A represents an alkyl group having 1 to 20 carbon atoms, an alkylene group, a substituted or unsubstituted aromatic group, or a substituted or unsubstituted aromatic group having a heterocyclic ring, and m is an integer of from 2 to 4.

In formula (2), B represents an alkyl group having 1 to 20 carbon atoms, an alkylene group, a substituted or unsubstituted aromatic group, or a substituted or unsubstituted aromatic group having a heterocyclic ring, and n is an integer of from 2 to 4.

The polyol having formula (1) is not particularly limited, and a proper polyol is chosen and used in consideration of the purpose of the toner.

Specific examples of the polyol include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxymethylbenzene, bisphenol A, ethylene oxide adducts of bisphenol A, propylene oxide adducts of bisphenol A, hydrogenated bisphenol A, ethylene oxide adducts of hydrogenated bisphenol A, propylene oxide adducts of hydrogenated bisphenol A, etc. These can be used alone or in combination.

The polycarboxylic acid having formula (2) is not particularly limited, and a proper polycarboxylic acid is chosen and used in consideration of the purpose of the toner.

Specific examples of the polycarboxylic acid include maleic acid, fumaric acid, citraconic acid, itaconic acid, glurtaconic acid, phthalic acid, isophthalic acid, terephthalic acid, succinic acid, adipic acid, sebacic acid, azelaic acid, malonic acid, n-dodecenylsuccinic acid, isooctylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxyic acid, 1,3-dicarboxy- 2-methyl-2-methylenecarboxypropane, 1,2,4-cyclohexanetricarboxylic acid, tetra(methylenecarboxy)methane, 1,2,7,8-octanetetracarboxylic acid, pyromellitic acid, trimer acids of EMPOL, cyclohexanedicarboxylic acid, cyclohexenedicarboxylic acid, butanetetracarboxylic acid, diphenylsulfonetetracarboxylic acid, ethylene glycol bis(trimellitic acid), etc.

These can be used alone or in combination.

<<<Modified Polyester Resin>>>

The modified polyester resin for use in the toner is not particularly limited, and a proper modified polyester resin is chosen and used in consideration of the purpose of the toner. For example, modified polyester resins, which are prepared by subjecting a combination of a compound having an active hydrogen atom and a polymer reactive with the compound having an active hydrogen atom to a polymer chain growth reaction and/or a crosslinking reaction, can be used.

The compound having an active hydrogen atom serves as a polymer chain growing agent and/or a crosslinking agent, which performs a polymer chain growth reaction and/or a crosslinking reaction in an aqueous phase liquid used for the toner manufacturing process. The compound having an active hydrogen group is not particularly limited as long as the compound has an active hydrogen atom. However, when the polymer reactive with the compound having an active hydrogen atom is such a polyester prepolymer having an isocyanate group as mentioned below, it is preferable to use an amine as the compound having an active hydrogen atom because the resultant modified polyester resin can have a high molecular weight.

The group having an active hydrogen atom is not particularly limited, and specific examples thereof include hydroxyl groups (alcoholic hydroxyl groups and phenolic hydroxyl groups), amino groups, carboxyl groups, mercapto groups, etc. The compound can include one or more of these groups.

The amine compound for use as the compound having an active hydrogen atom is not particularly limited, and for example diamines, polyamines having three or more amino groups, amino alcohols, amino mercaptans, amino acids, blocked amines in which the amino group of these amino compounds is blocked, can be used.

Specific examples of the diamines include aromatic diamines such as phenylenediamine, diethyltoluenediamine and 4,4'-diaminodiphenylmethane; alicyclic diamines such as 4,4'-diamino-3,3'-dimethyldicyclohexylmethane, diaminocyclohexane and isophoronediamine; aliphatic diamines such as ethylenediamine, tetramethylenediamine and hexamethylenediamine; etc.

Specific examples of the polyamines having three or more amino groups include diethylenetriamine, triethylenetetramine, etc.

Specific examples of the aminoalcohols include ethanolamine, hydroxyethylaniline, etc.

Specific examples of the amino mercaptans include aminoethyl mercaptan, aminopropyl mercaptan, etc.

Specific examples of the amino acids include aminopropionic acid, aminocaproic acid, etc.

Specific examples of the blocked amines include ketimine compounds, which can be prepared by reacting one of the above-mentioned compounds having an amino group (such as diamines, polyamines, amino alcohols, amino mercaptans, and amino acids) with a ketone (such as acetone, methyl ethyl ketone and methyl isobutyl ketone), and oxazoline compounds.

These compounds can be used alone or in combination.

Among these compounds, diamines and combinations of a diamine and a small amount of polyamine having three or more amino groups are preferable.

The polymer reactive with such a compound having an active hydrogen atom as mentioned above is not particularly limited as long as the polymer has a group reactive with the compound having an active hydrogen atom, and a proper polymer is chosen and used in consideration of the purpose of the toner. However, polyester resins having a group capable of forming a urea group (RMPEs) are preferable because of having advantages such that the polymer has a good combination of flowability and transparency when being melted; the molecular weight of the resultant polymer component can be easily adjusted; and the resultant toner has a good combination of low temperature fixability and releasability. Among these polyester resins, polyester prepolymers having an isocyanate group (hereinafter referred to as polyester prepolymers) are more preferable.

The average number of isocyanate groups included in one molecule of the polyester prepolymer is preferably not less than 1, more preferably from 1.2 to 5, and even more preferably from 1.5 to 4. When the average number of isocyanate groups is less than 1, the molecular weight of the resultant urea-modified polyester resin (RMPE) decreases, and thereby the hot offset resistance of the toner is often deteriorated.

The weight average molecular weight (Mw) of the polyester prepolymer is not particularly limited, and is set to a proper value. However, the weight average molecular weight of the tetrahydrofuran-soluble components of the polyester prepolymer is preferably from 3,000 to 40,000, and more preferably from 4,000 to 30,000 when the weight average molecular weight is measured with gel permeation chromatography (GPC). When the weight average molecular weight (Mw) is less than 3,000, the high temperature preservability of the toner tends to deteriorate. In contrast, when the weight average molecular weight (Mw) is greater than 40,000, the low temperature fixability of the toner tends to deteriorate.

In this application, the gel permeation chromatography (GPC) method used for determining the weight average molecular weight (Mw) is the following.

1) The columns are stabilized at 40° C. in a heat chamber;
2) Tetrahydrofuran (THF) is fed to the columns at a flow rate of 1 ml/min;
3) a sample (resin) is dissolved in THF to prepare a THF solution of the resin having a solid content of from 0.05 to 0.6% by weight; and
4) 50 to 200 μl of the solution is fed to the columns to measure the weight average molecular weight (Mw) of the resin using a working curve showing relation between counts and amounts and prepared by using several monodisperse polystyrenes.

The monodisperse polystyrenes prepared by Pressure Chemical Co. or Tosoh Corp., and having different molecular weights, $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, can be used for preparing the working curve. In this regard, it is preferable to use at least 10 monodisperse polystyrenes. In measurements, a RI (refractive index) detector was used as the detector.

The method of synthesizing the polyester prepolymer is not particularly limited. For example, a method in which a polycondensation product of a polyol and a polycarboxylic acid or a polyester resin having an active hydrogen is reacted with a polyisocyanate can be used. Specifically, a polyol and a polycarboxylic acid are heated to a temperature of from 150° C. to 280° C. in the presence of an esterification catalyst (such as titanium tetrabutoxide and dibutyltin oxide). In this regard, if desired, the reaction is performed at a reduced pressure while removing generated water. Thus, a polyester resin having a hydroxyl group is prepared. The polyester resin having a hydroxyl group is then reacted with a polyisocyanate to synthesize the polyester prepolymer.

The polyol used for synthesizing the polyester prepolymer is not particularly limited, and a proper polyol is chosen and used in consideration of the purpose of the polyester prepolymer. Specific examples of the polyol include alkylene glycols (e.g., ethylene glycol, 1,2-propylene glycol, 1,3-propylene glycol, 1,4-butenediol and 1,6-hexanediol); alkyleneether glycols (e.g., diethylene glycol, triethylene glycol, dipropylene glycol, polyethylene glycol, polypropylene glycol, and polytetramethyleneether glycol); alicyclic diols (e.g., 1,4-cyclohexanedimethanol and hydrogenated bisphenol A); bisphenol compounds (e.g., bisphenol A, bisphenol F, and bisphenol S); alkylene oxide (e.g., ethylene oxide, propylene oxide and butylene oxide) adducts of the alicyclic diols mentioned above; alkylene oxide (e.g., ethylene oxide, propylene oxide and butylene oxide) adducts of the bisphenol compounds mentioned above; aliphatic polyalcohols (e.g., glycerine, trimethylol ethane, trimethylol propane, pentaerythritol and sorbitol); polyphenol compounds having three or more hydroxyl groups (e.g., phenol novolac and cresol novolac); alkylene oxide adducts of the above-mentioned polyphenol compounds having three or more hydroxyl groups; mixtures of a diol and a polyol having three or more hydroxyl groups; etc. These can be used alone or in combination. Among these polyols, diols and combinations of a diol and a small amount of polyol having three or more hydroxyl group are preferable. Specific examples of the preferable diols include alkylene glycols having 2 to 12 carbon atoms, alkylene oxide adducts of bisphenol compounds such as ethylene oxide (2 mole) adducts of bisphenol A, propylene oxide (2 mole) adducts of bisphenol A, and propylene oxide (3 mole) adducts of bisphenol A.

The content of a polyol (polyol unit) in the polyester prepolymer having an isocyanate group is not particularly limited, but is preferably from 0.5 to 40% by weight, more preferably from 1 to 30% by weight, and even more preferably from 2 to 20% by weight. When the content is less than 0.5% by weight, the hot offset resistance of the toner deteriorates, namely, a good combination of high temperature preservability and low temperature fixability is hardly imparted to the toner. In contrast, when the content is greater than 40% by weight, the low temperature fixability of the toner tends to deteriorate.

The polycarboxylic acid used for synthesizing the polyester prepolymer is not particularly limited, and a proper polycarboxylic acid is chosen and used in consideration of the purpose of the polyester prepolymer. Specific examples of the polycarboxylic acid include alkylenedicarboxylic acids (e.g., succinic acid, adipic acid, and sebacic acid); alkenylenedicarboxylic acids having 4 to 20 carbon atoms (e.g., maleic acid, and fumaric acid); aromatic dicarboxylic acids having 8 to 20 carbon atoms (e.g., terephthalic acid, isophthalic acid, and naphthalenedicarboxylic acid); polycarboxylic acids having three or more carboxyl groups (e.g., aromatic polycarboxylic acids having 9 to 20 carbon atoms such as trimellitic acid, and pyromellitic acid); and mixtures of a dicarboxylic acid and a polycarboxylic acid having three or more carboxyl groups). Anhydrides and lower alkyl esters (such as methyl ester, ethyl ester and isopropyl ester) of these polycarboxylic acids can also be used. Among these polycarboxylic acids, combinations of a dicarboxylic acid (DIC) and a polycarboxylic acid (TC) having three or more carboxyl groups are preferable. The weight ratio (DIC/TC) of a dicarboxylic acid (DIC) to a polycarboxylic acid (TC) having three or more carboxyl groups is not particularly limited, but is preferably from 100/0.01 to 100/10, and more preferably from 100/0.01 to 100/1.

When a polyol and a polycarboxylic acid are subjected to a polycondensation reaction, the mixing ratio of the polyol to the polycarboxylic acid (i.e., equivalence ratio [OH]/[COOH]) is not particularly limited, but is preferably from 2/1 to 1/1, more preferably from 1.5/1 to 1/1, and even more preferably from 1.3/1 to 1.02/1.

The polyisocyanate used for synthesizing the polyester prepolymer is not particularly limited, and a proper polyisocyanate is chosen and used in consideration of the purpose of the polyester prepolymer. Specific examples of the polyisocyanate include aliphatic polyisocyanates (e.g., tetramethylene diisocyanate, hexamethylene diisocyanate, 2,6-diisocyanatocaproic acid methyl ester, octamethylene diisocyanate, decamethylene diisocyanate, dodecamethylene diisocyanate, tetradecamethylene diisocyanate, trimethylhexane diisocyanate, and tetramethylhexane diisocyanate); alicyclic polyisocyanates (e.g., isophorone diisocyanate, and cyclohexylmethane diisocyanate); aromatic diisocyanates (e.g., tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenylether-4,4'-diisocyanate); aromatic aliphatic diisocyanates (e.g., α, α, α', α'-tetramethylxylylene diisocyanate); isocyanurates (e.g., tris-isocyanatoalkyl-isocyanurate, and triisocyanatocycloalkyl-isocyanurate); derivatives of these compounds; and blocked isocyanates in which these compounds are blocked by a compound such as oximes and caprolactams.

These polyisocyanates can be used alone or in combination.

The content of a polyisocyanate (polyisocyanate unit) in the polyester prepolymer having an isocyanate group is not particularly limited, but is preferably from 0.5 to 40% by weight, more preferably from 1 to 30% by weight, and even more preferably from 2 to 20% by weight. When the content is less than 0.5% by weight, the hot offset resistance of the toner deteriorates, namely, a good combination of high temperature preservability and low temperature fixability is hardly imparted to the toner. In contrast, when the content is greater than 40% by weight, the low temperature fixability of the toner tends to deteriorate.

When a polyester resin having a hydroxyl group serving as a polyester resin having an active hydrogen atom is reacted with a polyisocyanate, the equivalence ratio [NCO]/[OH] of the isocyanate group [NCO] of the polyisocyanate to the hydroxyl group [OH] of the polyester resin having a hydroxyl group is not particularly limited, but is preferably from 5/1 to 1/1, more preferably from 4/1 to 1.2/1, and even more preferably from 3/1 to 1.5/1. When the equivalence ratio [NCO]/[OH] is less than 1/1, the hot offset resistance of the toner tends to deteriorate. In contrast, when the equivalence ratio is greater than 5/1, the low temperature fixability of the toner tends to deteriorate.

When a polyisocyanate is reacted with a polyester resin having a hydroxyl group, an organic solvent can be used if desired. Specific examples of such an organic solvent include organic solvents inactive against the isocyanate group such as aromatic solvents (e.g., toluene and xylene); ketones (e.g., acetone, methyl ethyl ketone, and methyl isobutyl ketone); esters (e.g., ethyl acetate); amides (e.g., dimethylformamide and dimethylacetamide); ethers (e.g., tetrahydrofuran); etc.

<<<Method for Synthesizing Modified Polyester Resin>>>

The method for synthesizing the modified polyester resin mentioned above is not particularly limited. For example, the following methods can be used.

(1) A solution or dispersion of a toner composition including a polymer reactive with a compound having an active hydrogen atom is emulsified or dispersed in an aqueous medium (aqueous phase liquid) together with the compound having an active hydrogen atom to form oil droplets in the aqueous medium. The polymer and the compound are subjected to a polymer chain growth reaction and/or a crosslinking reaction in the aqueous medium to synthesize the modified polyester resin.

(2) The solution or dispersion of a toner composition including a polymer reactive with a compound having an active hydrogen atom is emulsified or dispersed in an aqueous medium including the compound having an active hydrogen atom to form oil droplets in the aqueous medium. The polymer and the compound are subjected to a polymer chain growth reaction and/or a crosslinking reaction in the aqueous medium to synthesize the modified polyester resin.

(3) After the solution or dispersion of a toner composition including a polymer reactive with a compound having an active hydrogen atom is added to an aqueous medium, the compound having an active hydrogen atom is added to the mixture to form oil droplets. In this case, a polymer chain growth reaction and/or a crosslinking reaction is made while starting from the interface between the oil droplets and the aqueous medium, and therefore the modified polyester resin is synthesized in priority at the surface of toner particles, thereby making it possible to form concentration gradient of the modified polyester resin in the toner particles.

If desired, the polymer chain growth reaction and/or the crosslinking reaction may be stopped by using a reaction terminator such as diethylamine, dibutylamine, butylamine, laurylamine, and ketimine compounds in which a monoamine is blocked. Since the toner for use in the image forming apparatus of this disclosure includes a polyester resin (modified polyester resin) subjected to such a polymer chain growth reaction and/or a crosslinking reaction as mentioned above, the toner can have relatively good high temperature preservability compared to that of conventional toner including a polyester resin as a binder resin even when the glass transition temperature of the toner is lower than that of the polyester resin of the conventional toner.

When a urea-modified polyester resin is used as the modified polyester resin, the number average molecular weight of the modified polyester resin is not particularly limited, but is preferably from 1,000 to 10,000, and more preferably from 1,500 to 6,000.

The glass transition temperature (Tg) of the modified polyester resin is not particularly limited, but is preferably from 30° C. to 70° C., and more preferably from 40° C. to 65° C. When the glass transition temperature (Tg) is lower than 30° C., the high temperature preservability of the toner tends to deteriorate. In contrast, when the glass transition temperature (Tg) is higher than 70° C., the low temperature fixability of the toner tends to deteriorate.

The glass transition temperature (Tg) is measured with a thermogravimetric differential scanning calorimetric system (TG-DSC System) TAS-100 from Rigaku Corporation. The method is as follows.

(1) After about 10 mg of a sample is contained in an aluminum container, the container is set on a holder unit of the instrument, and the holder unit is set in an electric furnace of the instrument;

(2) The sample is heated from room temperature to 150° C. at a temperature rising speed of 10° C./min, followed by heating at 150° C. for 10 minutes and cooling to room temperature; and (3) After the sample is allowed to settle at room temperature for 10 minutes, the sample is heated again from room temperature to 150° C. at a temperature rising speed of 10° C./min in a nitrogen atmosphere to obtain a differential scanning calorimetry (DSC) curve of the sample.

The glass transition temperature (Tg) of the sample is determined using an analyzing system of TAS-100. The glass transition temperature (Tg) is defined as the temperature at which the tangent line of the endothermic curve of the DSC curve crosses the base line.

The modified polyester resin is not particularly limited as long as the resin is prepared by the synthesizing method mentioned above. Among various modified polyester resins, urea-modified polyester resins are preferable.

The urea-modified polyester resin for use in the toner of the image forming apparatus of this disclosure can include a urethane bond as well as a urea bond. In this regard, the molar ratio (UREA/URETHANE) of the urea group to the urethane group is not particularly limited, but is preferably from 100/0 to 10/90, more preferably from 80/20 to 20/80, and even more preferably from 60/40 to 30/70. When the molar ratio is less than 10/90, the hot offset resistance tends to deteriorate.

The urea-modified polyester resin is not particularly limited, and for example the following resins (1) to (10) can be used.

(1) Resins including a mixture of a urea-modified polyester resin, which is prepared by reacting a polycondensation product of an ethylene oxide (2 mole) adduct of bisphenol A and isophthalic acid with isophorone diisocyanate to prepare a polyester prepolymer, followed by reacting the polyester prepolymer with isophoronediamine, and a polycondensation product of an ethylene oxide (2 mole) adduct of bisphenol A and isophthalic acid;

(2) Resins including a mixture of a urea-modified polyester resin, which is prepared by reacting a polycondensation product of an ethylene oxide (2 mole) adduct of bisphenol A and isophthalic acid with isophorone diisocyanate to prepare a polyester prepolymer, followed by reacting the polyester prepolymer with isophoronediamine, and a polycondensation product of an ethylene oxide (2 mole) adduct of bisphenol A and terephthalic acid;

(3) Resins including a mixture of a urea-modified polyester resin, which is prepared by reacting a polycondensation product of an ethylene oxide (2 mole) adduct of bisphenol A, a propylene oxide (2 mole) adduct of bisphenol A and terephthalic acid with isophorone diisocyanate to prepare a polyester prepolymer, followed by reacting the polyester prepolymer with isophoronediamine, and a polycondensation product of an ethylene oxide (2 mole) adduct of bisphenol A, a propylene oxide (2 mole) adduct of bisphenol A and terephthalic acid;

(4) Resins including a mixture of a urea-modified polyester resin, which is prepared by reacting a polycondensation product of an ethylene oxide (2 mole) adduct of bisphenol A, a propylene oxide (2 mole) adduct of bisphenol A and terephthalic acid with isophorone diisocyanate to prepare a polyester prepolymer, followed by reacting the polyester prepolymer with isophoronediamine, and a polycondensation product of a propylene oxide (2 mole) adduct of bisphenol A and terephthalic acid;

(5) Resins including a mixture of a urea-modified polyester resin, which is prepared by reacting a polycondensation product of an ethylene oxide (2 mole) adduct of bisphenol A and terephthalic acid with isophorone diisocyanate to prepare a polyester prepolymer, followed by reacting the polyester prepolymer with hexamethylenediamine, and a polycondensation product of an ethylene oxide (2 mole) adduct of bisphenol A and terephthalic acid;

(6) Resins including a mixture of a urea-modified polyester resin, which is prepared by reacting a polycondensation product of an ethylene oxide (2 mole) adduct of bisphenol A and terephthalic acid with isophorone diisocyanate to prepare a polyester prepolymer, followed by reacting the polyester prepolymer with hexamethylenediamine, and a polycondensation product of an ethylene oxide (2 mole) adduct of bisphenol A, a propylene oxide (2 mole) adduct of bisphenol A and terephthalic acid;

(7) Resins including a mixture of a urea-modified polyester resin, which is prepared by reacting a polycondensation product of an ethylene oxide (2 mole) adduct of bisphenol A and terephthalic acid with isophorone diisocyanate to prepare a polyester prepolymer, followed by reacting the polyester prepolymer with ethylenediamine, and a polycondensation product of an ethylene oxide (2 mole) adduct of bisphenol A and terephthalic acid;

(8) Resins including a mixture of a urea-modified polyester resin, which is prepared by reacting a polycondensation product of an ethylene oxide (2 mole) adduct of bisphenol A and isophthalic acid with diphenylmethane diisocyanate to prepare a polyester prepolymer, followed by reacting the polyester prepolymer with hexamethylenediamine, and a polycondensation product of an ethylene oxide (2 mole) adduct of bisphenol A and isophthalic acid;

(9) Resins including a mixture of a urea-modified polyester resin, which is prepared by reacting a polycondensation product of an ethylene oxide (2 mole) adduct of bisphenol A, a propylene oxide (2 mole) adduct of bisphenol A, terephthalic acid and dodecenylsuccinic anhydride with diphenylmethane diisocyanate to prepare a polyester prepolymer, followed by reacting the polyester prepolymer with hexamethylenediamine, and a polycondensation product of an ethylene oxide (2 mole) adduct of bisphenol A, a propylene oxide (2 mole) adduct of bisphenol A and terephthalic acid;

(10) Resins including a mixture of a urea-modified polyester resin, which is prepared by reacting a polycondensation product of an ethylene oxide (2 mole) adduct of bisphenol A and isophthalic acid with toluene diisocyanate to prepare a polyester prepolymer, followed by reacting the polyester prepolymer with hexamethylenediamine, and a polycondensation product of an ethylene oxide (2 mole) adduct of bisphenol A and isophthalic acid.

The method for synthesizing such a urea-modified polyester resin is not particularly limited, and for example one shot methods can be used. Specifically, specific examples of the one shot methods include a method in which an amine serving as a compound having an active hydrogen atom and a polyester prepolymer including an isocyanate group, which serves as a polymer reactive with the compound having an active hydrogen atom, are subjected to a polymer chain growth reaction and/or a crosslinking reaction in an aqueous medium. The polymer chain growth reaction and the crosslinking reaction are not particularly limited, and depend on the combination of the compound having an active hydrogen atom and the polymer reactive with the compound having an active hydrogen atom. The reaction time is preferably from 10 minute to 40 hours, and more preferably from 2 hours to 24 hours.

In the synthesis of the urea-modified polyester resin, the mixing ratio of a polyester prepolymer having an isocyanate group to an amine is not particularly limited. However, the equivalence ratio [NCO]/[NHx] of the isocyanate group of the polyester prepolymer [NCO] to the amino group of the amine [NHx] is preferably from 1/3 to 3/1, more preferably from 1/2 to 2/1, and even more preferably from 1/1.5 to 1.5/1. When the mixing ratio [NCO]/[NHx] is less than 1/3, the low temperature fixability of the toner tends to deteriorate. In contrast, when the mixing ratio is greater than 3/1, the molecular weight of the urea-modified polyester resin decreases, resulting in deterioration of the hot offset resistance of the toner.

When the urea-modified polyester resin is synthesized by reacting a polyester prepolymer having an isocyanate group with an amine, an organic solvent can be used if desired. Specific examples of the organic solvent include organic solvents inactive against the isocyanate group such as aromatic solvents (e.g., toluene and xylene); ketones (e.g., acetone, methyl ethyl ketone, and methyl isobutyl ketone); esters (e.g., ethyl acetate); amides (e.g., dimethylformamide and dimethylacetamide); ethers (e.g., tetrahydrofuran); etc.

<Colorant>

The colorant included in the toner is not particularly limited, and any known dyes and pigments can be used. Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian Blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials are used alone or in combination.

The content of such a colorant in the toner is not particularly limited, but is preferably from 1% to 15% by weight, and more preferably from 3% to 10% by weight of the toner. When the content is less than 1% by weight, the tinting power of the toner tends to deteriorate. In contrast, when the content is greater than 15% by weight, problems such that the colorant cannot be well dispersed in the toner; the tinting power of the toner decreases; and the electric properties of the toner deteriorate tend to be caused.

Master batches, which are complexes of a colorant with a resin, can also be used as the colorant of the toner. Specific examples of the resin for use in the master batch include polyester resins, homopolymers of styrene or styrene derivatives (e.g., polystyrene, poly-p-chlorostyrene and polyvinyl toluene), styrene copolymers (e.g., styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers), polymethyl methacrylate resins, polybutyl methacrylate resins, polyvinyl chloride resins, polyvinyl acetate resins, polyethylene resins, polypropylene resins, epoxy resins, epoxy polyol resins, polyurethane resins, polyamide resins, polyvinyl butyral resins, polyacrylic acid resins, rosin, modified rosins, terpene resins, aliphatic or alicyclic hydrocarbon resins, aromatic petroleum resins, chlorinated paraffin, paraffin waxes, etc. These can be used alone or in combination.

The method for preparing the master batch is not particularly limited. For example, the master batch can be prepared by mixing or kneading a resin, a colorant, an organic solvent, etc. while applying a high shearing force thereto. In this case, the organic solvent is added to enhance the interaction between the colorant and the resin. In addition, a flushing method, in which an aqueous paste including a colorant and water is mixed or kneaded with a resin dissolved in an organic solvent to transfer the colorant from the aqueous phase to the resin side (i.e., the oil phase), and then the organic solvent (and water, if desired) is removed from the mixture, can be preferably used because the resultant wet cake of the colorant can be used without being dried. When performing the mixing and kneading process, dispersing devices capable of applying a high shearing force such as three roll mills can be preferably used.

The toner can further include other components such as release agents, layered inorganic materials, magnetic materials, cleanability improving agents, flowbility improving agents, and charge controlling agents.

The release agent optionally included in the toner is not particularly limited. Specific examples of the release agent include natural waxes such as vegetable waxes (e.g., carnauba waxes, cotton waxes, Japan waxes, and rice waxes), animal waxes (e.g., bees waxes, and lanolin), mineral waxes (e.g., ozocerite and ceresin waxes), and petroleum waxes (e.g., paraffin waxes, microcrystalline waxes and petrolatum); synthesized release agents such as synthesized hydrocarbon waxes (e.g., Fischer-Tropsch waxes, and polyethylene waxes), and synthesized waxes (e.g., esters, ketones and ethers); fatty acid amides (e.g., 12-hydroxystearamide, and stearamide); imides (e.g., phthalimide); chlorinated hydrocarbons; and crystallized polymers having a long alkyl group in a side chain thereof (e.g., n-stearyl polymethacrylate, n-lauryl polymethacrylate, and n-stearyl methacrylate—ethyl methacrylate copolymers). These release agents can be used alone or in combination.

Among these materials, waxes having a melting point of from 50 to 120° C. are preferable because such waxes can efficiently serve as a release agent between a fixing roller and the toner (i.e. toner image), and therefore the offset resistance of the toner can be enhanced without applying a release agent to the fixing roller.

The melting point of the release agent is not particularly limited, but is preferably from 50 to 120° C., and more preferably from 60 to 90° C. When the melting point is lower than 50° C., the preservability of the toner tends to deteriorate. In contrast, when the melting point is higher than 120° C., cold offset tends to be caused when the toner is fixed at a relatively low temperature. The melting point of the release agent can be measured by using a differential scanning calorimeter (TG-DSC system TAS-100 from Rigaku Corporation). In this regard, the melting point is defined as the temperature at which the maximum endothermic peak is observed in the DSC curve.

The release agent preferably has a melt viscosity of from 5 to 1,000 mP·s (cps), and more preferably from 10 to 100 mP·s (cps) at a temperature 20° C. higher than the melting point thereof. When the melt viscosity of the release agent is lower than 5 mP·s, it is hard to impart good releasability to the toner. In contrast, when the melt viscosity is higher than 1,000 mP·s, it is hard to impart a good combination of offset resistance and low temperature fixability to the toner.

The content of such a release agent in the toner is preferably not greater than 40% by weight, and more preferably from 3 to 30% by weight. When the content is greater than 40% by weight, the flowability of the toner tends to deteriorate.

It is preferable that the release agent is dispersed in the toner particles. Therefore, it is preferable that the release agent is not compatible with the binder resin. The method for finely dispersing a release agent in the toner particles is not particularly limited, and for example a method in which a release agent is mixed and kneaded with other toner components such as a binder resin while applying a shearing force thereto can be used.

The dispersion condition of a release agent in the toner particles can be determined by observing the thin film section of a toner particle with a transmission electron microscope (TEM). With respect to the diameter of the release agent dispersed in the toner particles, the smaller the better. However, when the diameter is too small, a problem in that the release agent cannot satisfactorily exude from the toner particles tends to be caused. Therefore, if the release agent can be observed when the thin film section of the toner particle is observed with a TEM of 10.000 power magnification, it can be said that the release agent is finely dispersed in the toner particles. In this regard, if the release agent cannot be observed, the release agent cannot satisfactorily exude from the toner particles in the fixing process even if the release agent is minutely dispersed in the toner particles.

The layered inorganic material optionally included in the toner is not particularly limited as long as the inorganic material has a structure such that layers with a thickness of a few nanometers are overlapped. Specific examples of such layered inorganic materials include montmorillonite, bentonite, hectorite, attapulgite, sepiolite, mixtures of these materials, etc. These can be used alone or in combination. Among these inorganic materials, modified layered inorganic materials are preferable because toner having irregular form can be granulated thereby, and a good combination of charge controlling property and low temperature fixability can be imparted to the toner. In addition, layered inorganic materials which have a montmorillonite crystalline structure and which are modified by an organic cation are more preferable. Further, modified montmorillonite or bentonite, which are modified by an organic cation are more preferable because the viscosity of the oil phase liquid used for preparing the toner can be controlled without adversely affecting the other toner properties.

It is preferable that part of layered inorganic material is modified with an organic ion. In this case, the layered inorganic material can have a proper hydrophobicity, and it becomes possible for the oil phase liquid including a toner composition and/or a toner composition precursor to have a non-Newtonian viscosity property while making it possible to form toner having irregular forms.

The content of such a modified layered inorganic material in the toner particles is not particularly limited, but is preferably from 0.05% to 5% by weight.

The magnetic material optionally included in the toner is not particularly limited. Specific examples thereof include iron powders, magnetite, ferrite, etc. Among these magnetic materials, white magnetic materials are preferably used because the color tone of the toner is not changed thereby.

The cleanability improving agent optionally included in the toner is not particularly limited as long as the agent can be added to enhance the cleaning ability of the toner to an extent such that residual toner remaining on a photoconductor or an intermediate transfer medium can be easily removed therefrom. Specific examples thereof include fatty acids and metal salts thereof such as stearic acid, zinc stearate and calcium stearate; particulate polymers such as particulate methyl methacrylate, and particulate polystyrene, which are prepared by a soap-free emulsion method; etc. The volume average particle diameter of such particulate polymers is not particularly limited, but is preferably from 0.01 μm to 1 μm.

The flowability improving agent optionally included in the toner is an agent which can be used for a surface treatment of the toner particles to enhance the hydrophobicity of the toner particles, thereby preventing deterioration of the flowing property and the charging property of the toner even under high humidity conditions. Specific examples thereof include silane coupling agents, silylating agents, silane coupling agents having a fluorinated alkyl group, organic titanate coupling agents, aluminum coupling agents, silicone oils, modified silicone oils, etc. In addition, the external additive of the toner such as silica and titanium oxide can be treated with such a flowability improving agent. It is preferable to use such a hydrophobized silica or titanium oxide as the external additive.

The charge controlling agent optionally included in the toner is not particularly limited, and a proper charge controlling agent is chosen and used in consideration of the purpose of the toner. Specific examples of Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, copper phthalocyanine, perylene, quinacridone, azo pigments, polymeric compounds having a functional group such as sulfonate groups, carboxylate groups, and quaternary ammonium groups, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE PSY VP2038, COPY CHARGE NEG VP2036 and NX VP434 (quaternary ammonium salt), which are manufactured by Hoechst AG; LRA-901 and LR-147, which are manufactured by Japan Carlit Co., Ltd.; etc.

The content of such a charge controlling agent in the toner is not particularly limited, but is preferably from 0.1 to 10 parts by weight, and more preferably from 0.2 to 5 parts by weight, based on 100 parts by weight of the binder resin included in the toner. When the content is greater than 10 parts by weight, the charge quantity of the toner tends to seriously increase, and the electrostatic attraction between the toner and a developing roller seriously increases, resulting in occurrence of problems in that the flowability of the toner deteriorates and the image density of toner images decreases. The charge controlling agent can be mixed and kneaded with such a master batch and a resin as mentioned above while melted, and the mixture is then dissolved or dispersed in an organic solvent to prepare an oil phase liquid. Alternatively, the charge controlling agent can be added to an organic solvent when preparing an oil phase liquid. In addition, it is possible to add the charge controlling agent to toner particles after the toner particles are prepared to fix the agent to the surface of the toner particles.

<Method for Preparing Toner>

The method for preparing the toner is not particularly limited and a proper method is chosen and used in consideration of the purpose of the toner. Specific examples thereof include pulverization methods, and polymerization methods. Among these methods, the polymerization methods are preferable because toner having a relatively small particle diameter can be produced thereby.

<<Pulverization Method>>

The pulverization method is not particularly limited. For example, methods in which toner components are melted and kneaded, and the kneaded mixture is pulverized and classified to prepare toner particles can be used. In this regard, a mechanical impact can be applied to the thus prepared toner particles in order to control the average circularity of the toner particle so as to be from 0.97 to 1.0. Specific examples of the method of applying a mechanical impact include methods using a device such as hybridizer and mechanofusion systems. By treating the thus prepared toner particles with an external additive, the toner for use in the image forming apparatus of this disclosure can be prepared.

<<Polymerization Method>>

The polymerization method is not particularly limited. Specific examples of the polymerization method include suspension polymerization methods, solution suspension polymerization methods, emulsification polymerization aggregation methods, etc. Among these methods, solution suspension (polymerization) methods, and emulsification polymerization aggregation methods are preferable, and solution suspension (polymerization) methods are more preferable.

Initially, the emulsification polymerization aggregation methods will be described. The emulsification polymerization aggregation method is not particularly limited. However, an emulsification polymerization aggregation method including an aggregating process, a fusing process, a washing and drying process, and an external additive treating process is preferable. Specifically, a method in which an oil phase liquid including a toner composition or a toner composition precursor is dispersed or emulsified in an aqueous phase liquid (aqueous medium) to perform granulation, thereby preparing toner particles can be used. By treating the thus prepared toner particles with an external additive, the toner for use in the image forming apparatus of this disclosure can be prepared.

In the aggregating process of the emulsification polymerization aggregation methods, a dispersion of a particulate resin prepared by emulsion polymerization, a layered inorganic material, at least part of which is modified with an organic ion, and a dispersion liquid of a colorant are mixed optionally together with a dispersion liquid of a release agent to prepare a dispersion liquid of aggregated particles. The aggregated particles in the dispersion liquid are aggregated by heteroaggregation. In order to stabilize the aggregated particles and to control the particle diameter and the particle diameter distribution of the aggregated particles, an ionic surfactant whose polarity is opposite to that of the aggregated particles or a mono- or more-valent compound (e.g., metal salts), which has a charge whose polarity is opposite to that of the aggregated particles can be added in the aggregating process.

In the aggregating process, aggregated particles are prepared by controlling the emulsifying power of an emulsifier by adjusting pH to properly cause aggregation. In this regard, in order to rapidly perform aggregation of particles stably while forming aggregated particles having a relatively narrow particle diameter distribution, an aggregating agent can be added. The aggregating agent is not particularly limited, and specific examples of the aggregating agent include compounds having a mono- or more-valent charge. Specific examples of such compounds include water-soluble surfactants such as nonionic surfactants; acids such as hydrochloric acid, sulfuric acid, nitric acid, acetic acid, and oxalic acids; metal salts of inorganic acids such as magnesium chloride, sodium chloride, aluminum sulfate, calcium sulfate, ammonium sulfate, aluminum nitrate, silver nitrate, copper sulfate, and sodium carbonate; metal salts of organic acids such as metal salts of fatty acids and aromatic acids (e.g., sodium acetate, potassium formate, sodium oxalate, sodium phthalate, and potassium salicylate), metal salts of phenols (e.g., sodium phenolate), metal salts of amino acids, and inorganic acid salts of aliphatic or aromatic amines (e.g., triethanolamine hydrochloride, and aniline hydrochloride); etc. Among these materials, metal salts of inorganic acids are preferable because of having advantages such that the aggregated particles have good stability (i.e., good resistance to heat and good stability with elapse of time), and the metal salts of inorganic acids can be easily removed in the cleaning process. The added amount of such an aggregating agent is not particularly limited, and changes depending on the valence of the agent. However, the added amount is preferably not greater than 3% by weight (when the agent is a monovalent material), 1% by weight (when the agent is a divalent material), or 0.5% by weight (when the agent is a trivalent material). Since the added amount of an aggregating agent can be decreased when the agent have a greater valence, compounds having a greater valence are preferably used as the aggregating agent.

In the fusing process, the dispersion liquid of aggregated particles prepared in the aggregating process is heated so that the particles are fused, thereby forming toner particles. In this regard, it is possible to perform an adhering process at an early stage of the fusing process such that another dispersion liquid of a particulate material is added to the dispersion liquid of aggregated particles to evenly adhere the particulate material to the surface of the aggregated particles. In addition, in order to adhere a layered inorganic material, at least part of which is modified with an organic material ion, to the aggregated particles, the adhering process can be performed. In this adhering process, the layered inorganic material modified with an organic material ion is adhered to the aggregated particles, and then another dispersion liquid of a particulate material is added thereto while mixed so that the particulate material is adhered to the surface of the aggregated particles. These materials are adhered to the aggregated particles by heteroaggregation. When a dispersion liquid of a particulate resin is used, it is preferable to heat the aggregated particles, to which the particulate resin is adhered, at a temperature higher than the glass transition temperature of the particulate resin to form fused particles. Since the fused particles are present in the aqueous medium as colored fused particles, the fused particles can be separated from the aqueous medium in the washing process while removing impurities, which are mixed therewith in the former processes. The thus obtained fused particles are dried to prepare a powdery toner.

In the washing process, acidic or basic water in an amount several times the amount of the fused particles is added to the fused particles, and the mixture is agitated and then filtered to obtain a colored particulate material. Further, acidic or basic water in an amount several times the amount of the colored particulate material is added to the colored particulate material, and the mixture is then filtered. This washing treatment is performed several times until the filtrate has a pH of about 7. The colored particulate material is then dried to prepare a colored toner.

In the drying process, the colored toner prepared above is heated at a temperature lower than the glass transition temperature of the toner. In this regard, dried air may be circulated if desired. Alternatively, the drying process may be performed in vacuum.

Next, the solution suspension (polymerization) method will be described.

The solution suspension (polymerization) method is not particularly limited, but aqueous methods in which particles are prepared in an aqueous medium are preferable. Among various aqueous methods, a method including an oil phase liquid preparing process, an aqueous phase liquid preparing process, an emulsifying and dispersing process, a solvent removing process, a washing and drying process, and an external additive treating process is more preferable.

Specifically, a method including dissolving or dispersing at least a binder resin and a colorant in an organic solvent to prepare an oil phase liquid; adding the oil phase liquid to an aqueous phase liquid to emulsify or disperse the oil phase liquid in the aqueous phase liquid; removing the organic solvent from the emulsion or dispersion liquid to prepare toner particles; and mixing the toner particles with an external additive to prepare a toner is preferable.

Among the solution suspension methods, an ester extension method is preferable. Specific examples of the ester extension method include a method including dissolving or dispersing a toner composition, which includes at least a compound having an active hydrogen atom, a polymer reactive with the compound having an active hydrogen atom, a binder resin, and a colorant, in an organic solvent to prepare an oil phase liquid; adding the oil phase liquid to an aqueous phase liquid to emulsify or disperse the oil phase liquid in the aqueous phase liquid while subjecting the compound having an active hydrogen atom and the polymer to a polymer chain growth reaction and/or a crosslinking reaction in the emulsion or dispersion liquid; removing the organic solvent from the emulsion or dispersion liquid to prepare toner particles; and mixing the toner particles with an external additive to prepare a toner.

Next, the processes of the solution suspension method will be described in detail.

In the oil phase liquid preparing process, toner components including at least a binder resin component and a colorant are dissolved or dispersed in an organic solvent to prepare an oil phase liquid (i.e., solution or dispersion of toner components). In this regard, the toner components other than the compound having an active hydrogen atom and the polymer reactive with the compound are not necessarily included in the oil phase liquid, and may be added to the aqueous phase liquid (mentioned later) in the aqueous phase liquid preparing process. Alternatively, the toner components other than the compound having an active hydrogen atom and the polymer reactive with the compound may be added to the aqueous phase liquid together with the oil phase liquid when the oil phase liquid is added to the aqueous phase liquid.

The organic solvent used for preparing the oil phase liquid is not particularly limited, but organic solvents having a boiling point of lower than 150° C. are preferable because such organic solvents can be easily removed in the solvent removing process. Specific examples of such organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These can be used alone or in combination. Among these, ethyl acetate, toluene, xylene, benzene, methylene chloride, 1,2-dichloroethane, chloroform, and carbon tetrachloride are preferable, and ethyl acetate is more preferable. The amount of the organic solvent is not particularly limited, but is preferably from 40 to 300 parts by weight, more preferably from 60 to 140 parts by weight, and even more preferably from 80 to 120 parts by weight, based on 100 parts by weight of the toner components used.

In the aqueous phase liquid preparing process, the aqueous phase liquid is prepared. The aqueous phase liquid is not particularly limited. For example, water, solvents mixable with water, and mixtures thereof can be used. Among these solvents, water is preferable. Specific examples of the solvents mixable with water include alcohols (e.g., methanol, isopropanol, and ethylene glycol), dimethylformamide, tetrahydrofuran, cellosolves (e.g., METHYL CELLOSOLVE®), lower ketones (e.g., acetone and methyl ethyl ketone), etc.

In the emulsifying and dispersing process, the above-prepared oil phase liquid is dispersed in the aqueous phase liquid to prepare an emulsion or dispersion liquid. All the toner components are not necessarily mixed until particles are formed in the aqueous phase liquid, and can be added after particles are formed in the aqueous phase liquid. For example, when particles having no colorant are formed, the particles can be dyed with a colorant using a known dyeing method. The amount of the aqueous phase liquid is not particularly limited, but is preferably from 50 to 2,000 parts by weight, and more preferably from 100 to 1,000 parts by weight, based on 100 parts by weight of the toner components used for preparing the toner. When the amount of the aqueous phase liquid is less than 50 parts by weight, the toner components cannot be well dispersed in the aqueous phase liquid, thereby often causing a problem in that the resultant toner particles do not have the desired average particle diameter. In contrast, using the aqueous phase liquid in an amount of greater than 2,000 is not economical. In this regard, a dispersant is preferably used when the oil phase liquid is dispersed in the aqueous phase liquid. In this case, the resultant particles can have a sharp particle diameter distribution while having good dispersion stability.

The dispersant is not particularly limited, and a proper dispersant can be chosen and used in consideration of the purpose of the toner. Specific examples of the dispersant include anionic surfactants which can include a fluoroalkyl group, cationic surfactants which can include a fluoroalkyl group, nonionic surfactants, ampholytic surfactants, inorganic compounds (e.g., tricalcium phosphate, calcium carbonate, titanium oxide, colloidal silica and hydroxyapatite), particulate polymers (e.g., particulate methyl methacrylate polymers having an average particle diameter of 1 μm, particulate polymethyl methacrylate having an average particle diameter of 3 μm, particulate polystyrene having an average particle diameter of 0.5 mm, particulate polystyrene having an average particle diameter of 2 μm, and particulate styrene-acrylonitrile copolymers having an average particle diameter of 1 μm), etc. Among these, surfactants having a fluoroalkyl group are preferable because the effect can be produced even when the added amount is little.

The added amount of such a dispersant is not particularly limited. However, when the dispersant is used for a particulate resin dispersion liquid, the added amount is preferably from 0.01% to 1% by weight, more preferably from 0.02% to 0.5% by weight, and more preferably from 0.1% to 0.2% by weight. In this case, when the added amount is less than 0.01% by weight, aggregation of the particles may be caused in the resultant emulsion or dispersion liquid even when the resultant emulsion or dispersion liquid does not have a pH in a fully basic range. When the dispersant is used for a dispersion liquid of colorant or release agent, the added amount is preferably from 0.01% to 10% by weight, more preferably from 0.1% to 5% by weight, and more preferably from 0.2% to 0.5% by weight. In this case, when the added amount is less than 0.01% by weight, a problem such that particles of a specific component among the toner components are formed in priority because the toner components have different stability is often caused. In contrast, when the added amount is greater than 10% by weight, problems such that the resultant particles have a wide particle diameter distribution; and the average particle diameter of the resultant particles cannot be controlled tend to be caused.

Specific examples of the marketed products of such dispersants include SARFRONs S-111, S-112, S-113 and 121, which are manufactured by Asahi Glass Co., Ltd.; FLUORADs FC-93, FC-95, FC-98, FC-129 and FC-135, which are manufactured by Sumitomo 3M Ltd.; UNIDYNEs DS-101, DS-102 and DS-202, which are manufactured by Daikin Industries, Ltd.; MEGAFACEs F-110, F-120, F-113, F-150, F-191, F-812, F-824 and F-833, which are manufactured by DIC Corp.; ECTOPs EF-102, 103, 104, 105, 112, 123A, 123B, 132, 306A, 501, 201 and 204, which are manufactured by Tohchem Products Co., Ltd.; FUTARGENTs F-100, F300 and F150 manufactured by Neos; SGP and SGP-3G from Soken Chemical & Engineering Co., Ltd.; PB-200H from Kao Corp.; TECHNOPOLYMER SB from Sekisui Plastics Co., Ltd.; MICROPEARL from Sekisui Chemical Co., Ltd.; etc.

When a dispersant is used, it is possible for the dispersant to remain on the surface of the resultant toner particles. However, it is preferable that after the reaction, the resultant toner particles are washed to remove the dispersant from the toner particles so that the toner particles have good charging property. In addition, in order that the viscosity of the oil phase liquid including the toner components decreases, and the resultant toner particles have a sharp particle diameter distribution, it is preferable to use a solvent capable of dissolving the modified polyester resin, which is produced by the reaction of the polyester prepolymer. The solvent preferably has a boiling point of lower than 100° C. so as to be easily removed in the solvent removing process. Specific examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, tetrahydrofuran, and water-mixable solvents such as methanol. These solvents can be used alone or in combination. Among these solvents, aromatic solvents such as toluene and xylene, and halogenated hydrocarbons such as methylene chloride, 1,2-dichloroethane, chloroform and carbon tetrachloride are preferable.

When a dispersant is used, it is preferable to use a dispersion stabilizer. Polymeric protection colloids can be used as the dispersion stabilizer. The polymeric protection colloid is not particularly limited as long as the colloid includes a water-insoluble particulate organic material or the like and stabilizes the dispersed droplets of the oil phase liquid.

Specific examples of such a protection colloid include polymers and copolymers prepared using one or more monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate), acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkylamines, polyoxypropylenealkylamines, polyoxyethylenealkylamides, polyoxypropylenealkylamides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When a dispersion stabilizer such as calcium phosphate, which can be dissolved in an acid or an alkali, is used, it is preferable to dissolve the dispersion stabilizer with an acid such as hydrochloric acid to remove the dispersion stabilizer from the toner particles, followed by washing the toner particles with water. In addition, it is possible to remove such a dispersion stabilizer by decomposing the dispersion stabilizer using an enzyme.

The dispersing machine used for emulsifying or dispersing the oil phase liquid in the aqueous phase liquid is not particularly limited, and known dispersing machines such as low speed shear dispersing machines, high speed shear dispersing machines, friction dispersing machines, high pressure jet dispersing machines, and ultrasonic dispersing machines can be used. Among these dispersing machines, high speed shear dispersing machines are preferable because the particle diameter of the droplets of the oil phase liquid can be controlled so as to be from 2 μm to 20 μm.

When high speed shear dispersing machines are used, the rotation number of the rotor is not particularly limited, but the rotation number is preferably from 1,000 to 30,000 rpm, and preferably from 5,000 to 20,000 rpm. The dispersing time is not particularly limited, but is preferably from 0.1 to 5 minutes when a batch system is used. The dispersing temperature is not particularly limited, but is preferably from 0 to 150° C. (under pressure) and more preferably from 40 to 98° C.

In the solvent removing process, the organic solvent is removed from the emulsion or dispersion. The method for removing the organic solvent is not particularly limited. Specific examples of the method include methods in which the entirety of the reaction system is gradually heated to evaporate the organic solvent included in the oil droplets in the emulsion or dispersion liquid; methods in which the emulsion or dispersion liquid is ejected into a dry and heated atmosphere gas (such as air, nitrogen gas, carbon dioxide gas and combustion gas) to dry the organic solvent in the oil droplets in the emulsion or dispersion liquid; etc. By using these methods, toner particles having desired properties can be produced in a short time. Thus, by removing the organic solvent, toner particles (i.e., mother toner) can be prepared.

In the washing and drying process, the toner particles prepared above are washed and dried. The dried toner particles can be further classified. The classification process can be performed on the dispersion liquid including the toner particles in the washing process or after the washing process using a device such as cyclones, decanters, and centrifugal separators to remove relatively fine particles. Alternatively, the classification process can be performed after the toner particles are washed and dried. In this regard, the fine particles and coarse particles separated from the toner particles can be reused as a toner component for forming the toner particles. When the fine particles and coarse particles are reused, the state of the particles is not particularly limited, and the particles may be in a wet state or a dry state.

In the external additive treating process, the dried toner particles are mixed with an external additive, which includes united particles having such properties as mentioned above. By mixing the toner particles prepared above and the external additive, the toner, which can be used for the image forming apparatus of this disclosure, can be prepared. The mixer used for mixing the toner particles and the external additive is not particularly limited, but a HENSCHEL MIXER mixer (from Mitsui Mining Co., Ltd.) is preferably used. In this regard, in order to prevent particles of the external additive from releasing from the surface of the toner particles, a mechanical impact can be applied to the external additive. The method of applying a mechanical impact is not particularly limited, and specific examples thereof include methods in which an impact is applied by using a blade rotating at a high speed; methods in which the mixture is fed into a high speed airflow so that the mixture is accelerated and the particles are collided with each other or a collision plate; etc. Specific examples of the device used for the methods include ONG MILL (from Hosokawa Micron Corp.), modified I-TYPE MILL (from Nippon Pneumatic, Mfg. Co., Ltd.), which is modified to decrease the pulverization air pressure, HYBRIDIZATION SYSTEM (from Nara Machinery Co., Ltd.), KRYPTRON SYSTEM (from Kawasaki Heavy Industries, Ltd.), automatic mortars, etc.

Next the properties of the toner for use in the image forming apparatus of this disclosure will be described.

The ratio (Dw/Dn) of the weight average particle diameter (Dw) of the toner to the number average particle diameter (Dn) thereof is not particularly limited, but is preferably not greater than 1.30, and more preferably from 1.00 to 1.30. When the ratio is less than 1.00, the toner tends to cause a problem such that the toner is fixedly adhered to the surface of the carrier, which is used for a two-component developer together with the toner, when the two-component developer is agitated over a long period of time in a developing device, thereby deteriorating the charging ability and the cleanability of the carrier. When such a toner is used as a one-component developer, the toner tends to cause problems such that the toner is adhered to a developing roller while forming a toner film thereon; and the toner is fixedly adhered to a blade used for forming a toner layer on the developing roller. In contrast, when the ratio is greater than 1.30, it becomes hard for the toner to produce images with high resolution and high quality, and in addition the average particle diameter of the toner in the developer tends to largely change when the toner is repeatedly used in a developing device while a new toner is added to the developer in the developing device to compensate for the toner used for development.

The average circularity of the toner is not particularly limited, but is preferably from 0.94 to 0.99. When the average circularity is less than 0.94, uniformity of toner images formed on the photoconductor in the developing process deteriorates, and transferability of toner images transferred from the photoconductor to the intermediate transfer medium or from the intermediate transfer medium to a recording medium deteriorates, thereby often making it impossible to produce images with good evenness.

Since the toner for use in the image forming apparatus of this disclosure is prepared by performing such an emulsifying process as mentioned above in an aqueous medium, the toner has an average circularity in the above-mentioned range while having a relatively small particle diameter, and therefore the toner can be preferably used, particularly, as color toner.

The average circularity of the toner is measured using a flow particle image analyzer FPIA-2000 from Sysmex Corp. The procedure is the following.

(1) Initially, 100 to 150 ml of water, from which solid foreign materials have been removed, a dispersant (preferably 0.1 to 0.5 ml of a surfactant), and 0.1 to 9.5 g of a sample (i.e., toner) are mixed to prepare a suspension;
(2) The suspension is further subjected to a supersonic dispersing treatment for 1 to 3 minutes using a supersonic disperser to prepare a dispersion liquid including particles of the sample at a concentration of from 3,000 to 10,000 pieces/μl;
(3) The thus prepared dispersion liquid is set in the analyzer so that the particles pass through a detection area formed on a plate in the analyzer; and
(4) The particles of the sample passing through the detection area are optically detected by a CCD camera, and then the shapes of the toner particles and the distribution of the shapes are analyzed by an image analyzer to determine the average circularity of the sample.

Next, the developer for use in the image forming apparatus of this disclosure will be described.

The developer includes at least the toner mentioned above, and a carrier when the developer is used as a two-component developer. In this regard, the toner is mixed with a carrier to prepare the two-component developer. When the toner is used as a one-component developer, the toner is used as a one-component magnetic developer (i.e., one-component magnetic toner) or a one-component non-magnetic developer (i.e., one-component non-magnetic toner).

The carrier for use in the two-component developer includes a particulate magnetic core, and a resin covering the particulate magnetic core, and optionally includes other components such as particulate electroconductive materials and silane coupling agents. It is preferable that each of the carrier and the particulate magnetic core has a proper particle diameter.

The weight ratio (T/C) of the toner (T) to the carrier (C) is preferably from 1/100 to 10/100.

The weight average particle diameter of the carrier is preferably from 15 μm to 40 μm. When the weight average particle diameter is less than 15 μm, the carrier (developer) tends to cause a carrier adhesion problem such that particles of the carrier in the developer adhere to an electrostatic latent image in the developing process together with the toner. In contrast, when the weight average particle diameter is greater than 40 μm, the developer tends to cause a background development problem such that the background of an image is soiled with the toner, when the concentration of toner in the developer is increased to produce high density images. In addition, when the developer is used for developing electrostatic latent dot images, the developer tends to cause problems such that reproducibility of the dot images deteriorates (i.e., the diameter of the resultant dot toner images varies), and highlight image portions become grainy.

The core of the carrier is not particularly limited as long as the resultant carrier can have a magnetic moment of not less than 40 emu/g (i.e., 0.04 $A \cdot m^2/g$) at 1000 Oe ($7.96 \times 10^4$ A/m). Specific examples of the core include ferromagnetic materials such as iron and cobalt; magnetite, hematite, lithium ferrite, manganese zinc ferrite, copper zinc ferrite, nickel zinc ferrite, barium ferrite, manganese ferrite, etc. When a particulate magnetic material prepared by pulverizing a magnetic material such as ferrite and magnetite is used as the core material, it is preferable that the particulate magnetic material is initially classified before the particulate magnetic material is calcined. Next, the calcined particulate magnetic material is classified to produce several groups of powders of the magnetic material having different average particle diameters. In this regard, one of the groups of powders is used as the core or two or more of the groups of powders are mixed to be used as the core.

The method for use in the classification is not particularly limited, and known classification methods using a device such as sieves, gravitational classifiers, centrifugal classifiers, and inertial classifiers can be used. Among these, air classifiers such as gravitational classifiers, centrifugal classifiers, and inertial classifiers are preferable because the devices have good productivity and the classification point (i.e., targeted classification particle diameter) can be easily changed.

The carrier can be covered with a resin. The covering resin is not particularly limited. Specific examples of the covering resin include amino resins, urea-formaldehyde resins, melamine resins, guanamine resins, urea resins, polyamide resins, polyvinyl resins, polyvinylidene resins, acrylic resins, polymethyl methacrylate resins, polyacrylonitirile resins, polyvinyl acetate resins, polyvinyl alcohol resins, polyvinyl butyral resins, styrene resins (such as polystyrene resins and styrene-acrylic copolymers), halogenated olefin resins (such as polyvinyl chloride resins), polyester resins, polyethylene terephthalate resins, polybutylene terephthalate resins, polycarbonate resins, polyethylene resins, polyvinyl fluoride resins, polyvinylidene fluoride resins, polytrifluoroethylene resins, polyhexafluoropropylene resins, copolymers of vinylidenefluoride and an acrylic monomer, vinylidene fluoride-vinyl fluoride copolymers, terpolymers of tetrafluoroethylene, vinylidene fluoride and other monomers including no fluorine atom, silicone resins, epoxy resins, etc. These resins can be used alone or in combination.

The method for preparing the carrier is not particularly limited, and for example a method in which a cover layer is formed on such a core as mentioned above can be used. The method for forming the cover layer on the surface of the core is not particularly limited. Specific examples of the method include spray drying methods, dipping methods, powder coating methods, etc. Among these methods, methods using a fluidized bed type coater are preferable because an even cover layer can be formed on the surface of the core.

The image forming apparatus of this disclosure is not limited to the example mentioned above, and includes the following embodiments, which produce specific effects, respectively.

Embodiment 1

Embodiment 1 is an image forming apparatus, which includes a rotatable image bearer (such as the photoconductor 2) to bear a toner image on a surface thereof, a transferring device (such as the intermediate transfer unit 8) to transfer the toner image on the surface of the image bearer to a recording medium eventually in a normal image forming operation, and a cleaning blade (such as the blade member 5A) contacted with the surface of the image bearer to clean the surface of the image bearer by blocking toner, which remains on the surface of the image bearer without being transferred in the transferring process. After the image forming apparatus performs an operation (such as the special toner image forming operation mentioned above (e.g., the toner pattern forming operation mentioned below)) such that the amount of the toner input to the cleaning blade in the operation is greater than the amount of the toner input to the cleaning blade in the normal image forming operation and then stops rotation of the image bearer, the image forming apparatus performs an inverse rotation operation such that the image bearer is rotated in a direction opposite to the normal rotation direction of the image bearer in the normal image forming operation.

The present inventors have diligently investigated the reason for the filming problem such that a film of a material such as toner is fixedly adhered to the surface of the image bearer (such as the photoconductor 2). As a result thereof, the following can be found.

Specifically, in the image forming apparatus of Embodiment 1, a toner pattern forming operation of forming a strip-shaped toner pattern on the surface of the image bearer is performed with a predetermined timing so that the strip-shaped toner pattern is input to the cleaning blade without being transferred. When such a toner pattern forming operation is performed, a larger amount of toner is input to the cleaning blade than in the normal image forming operation. The toner thus input to the cleaning blade is blocked by the cleaning blade, and stays in the wedge-shaped gap H between the tip of the cleaning blade and the surface of the image bearer as illustrated in FIG. 14. In this case, the amount of toner staying in the wedge-shaped gap H increases, and thereby the film removing effect of removing the film on the surface of the image bearer can be enhanced. However, when rotation of the image bearer is stopped, the large amount of toner remains in the wedge-shaped gap H, and therefore a high pressure is applied to the toner. When the toner in the wedge-shaped gap H is allowed to settle over a long period of time, the toner is fixedly adhered to the surface of the image bearer, thereby causing the filming problem.

The same is true for a case in which a recoding medium sheet jams in the image forming apparatus. Specifically, the toner image on the image bearer, which toner image is to be transferred to the jammed recording medium sheet, is also input to the cleaning blade without being transferred. In this case, a larger amount of toner is input to the cleaning blade than in the normal image forming operation. In this regard, it is possible that the toner input to the cleaning blade is allowed to settle in the wedge-shaped gap H over a long period of time. In this case, the filming problem can be caused.

According to Embodiment 1, after an operation (such as the toner pattern forming operation) such that the amount of toner input into the cleaning blade is greater than that in the normal image forming operation is performed and then rotation of the image bearer (such as the photoconductor 2) is stopped, the image bearer is rotated in a direction opposite to that in the normal image forming operation so that the toner present in the wedge-shaped gap H and receiving a high pressure can be released from the gap H, thereby making it possible to prevent occurrence of the filming problem. Even when the toner released from the gap H is allowed to settle over a long period of time, the toner is adhered to the surface of the image bearer by a force such as intermolecular force. Therefore, when an image forming operation is performed thereafter, the toner released from the gap H but adhered to the surface of the image bearer is input again to the cleaning blade, thereby making it possible to produce the film removing effect (i.e., the effect of removing (i.e., scratching off) a film on the image bearer with the toner blocked by the cleaning blade).

Embodiment 2

Embodiment 2 is characterized in that, in the image forming apparatus of Embodiment 1, the image forming apparatus performs a toner removing operation such that whenever the normal image forming operation is ended, the image bearer is rotated with a predetermined travel length in a direction opposite to that in the normal image forming operation, wherein the travel length of the image bearer in the inverse rotation operation is longer than the travel length of the image bearer in the toner removing operation.

According to Embodiment 2, by inversely rotating the image bearer in the inverse rotation operation with a longer travel length than in the toner removing operation, occurrence of the filming problem can be prevented relatively securely compared to a case in which the travel length in the inverse rotation operation is the same as that in the toner removing operation even after the image forming apparatus is allowed to settle over a long period of time.

Embodiment 3

Embodiment 3 is characterized in that, in the image forming apparatus of Embodiment 1 or 2, the operation such that the amount of the toner input to the cleaning blade in the operation is greater than the amount of the toner input to the cleaning blade in the normal image forming operation is a toner pattern forming operation such that a toner pattern such as a strip-shaped toner pattern is formed on the image bearer and the toner pattern is input to the cleaning blade without being transferred.

According to Embodiment 3, since the toner pattern is input to the cleaning blade such as the blade member 5A, a large amount of toner is present in the wedge-shaped gap H. Therefore, by performing the toner pattern forming operation and then performing the inverse rotation operation to release the toner from the gap H, occurrence of the filming problem can be prevented even when the image forming apparatus is allowed to settle over a long period of time.

Embodiment 4

Embodiment 4 is characterized in that, in the image forming apparatus of Embodiment 3, the image forming apparatus further includes a temperature detector (such as the temperature sensor 602) to detect the internal temperature of the image forming apparatus, and the image forming apparatus determines whether or not the toner pattern forming operation is performed based on an index value (such as the cumulative filming counter value F), which is calculated from a parameter relating to the operating time of the image forming apparatus (such as the cumulative operating time of the image forming operation, and the cumulative traveling length of the image bearer) and the detection result of the temperature detector.

As mentioned above, the operating time of the image forming operation and the internal temperature of the image forming apparatus have good correlationship with the time at which quality of images produced by the image forming apparatus deteriorates due to formation of film on the image bearer. Therefore, by forming the toner pattern based on the above-mentioned index value, the toner pattern can be input to the cleaning blade before the image quality deteriorates, thereby making it possible to prevent occurrence of the filming problem over a long period of time. In addition, the consumption of the toner can be reduced compared to a case in which the toner pattern is intermittently input to the cleaning blade. Further, the toner pattern forming operation does not cause down time because the toner pattern forming operation is not performed at the initial stage of the image forming apparatus.

Embodiment 5

Embodiment 5 is characterized in that, in the image forming apparatus of any one of Embodiments 1 to 4, the image forming apparatus includes a black image forming unit including at least the image bearer and the cleaning blade to form a black toner image on the image bearer, and at least one color image forming unit including at least the image bearer and the cleaning blade, which are different from those of the black image forming unit, to form a color toner image on the image bearer. When the operation such that the amount of the toner input to the cleaning blade in the operation is greater than the amount of the toner input to the cleaning blade in the normal image forming operation is performed only in the black image forming unit, the inverse rotation operation is performed only in the black image forming unit. When the operation such that the amount of the toner input to the cleaning blade in the operation is greater than the amount of the toner input to the cleaning blade in the normal image forming operation is performed in one of the at least one color image forming unit, the inverse rotation operation is performed in all of the at least one color image forming unit.

According to Embodiment 5, the operations of the at least one color image forming unit (such as Y, M and C color image forming units) can be coordinated with each other, and therefore the color image forming units have the same life (i.e., same replacement time). Namely, such Y, M and C color image forming units can be replaced at once, and thereby the maintainability of the image forming apparatus can be enhanced.

Additional modifications and variations of the present invention are possible in light of the above teachings. It is therefore to be understood that within the scope of the appended claims the invention may be practiced other than as specifically described herein.

What is claimed is:

1. An image forming apparatus comprising:

at least one rotatable image bearer which rotates in a first rotation direction while bearing an image of toner on a surface thereof in a normal image forming operation;

a toner image forming device to form the toner image on the surface of the at least one image bearer;

a transferring device to transfer the toner image on the at least one image bearer rotating in the first rotation direction to a recording medium eventually in the normal image forming operation;

at least one cleaning blade contacted with the surface of the at least one image bearer to block the toner, which remains on the surface of the at least one image bearer without being transferred and which is input to the at least one cleaning blade due to rotation of the at least one rotatable image bearer in the first rotation direction, to clean the surface of the at least one image bearer; and a controller to control the image forming apparatus, wherein the controller controls the at least one image bearer to perform an inverse rotation operation in which the at least one image bearer rotates in a second rotation direction opposite to the first rotation direction after controlling the toner image forming device to perform a special image forming operation in which a special toner image is formed on the surface of the at least one image bearer and then input to the at least one cleaning blade in such a manner that an amount of the toner input to the at least one cleaning blade in the special image forming operation is greater than an amount of the toner input to the at least one cleaning blade in the normal image forming operation, and then stopping the at least one image bearer rotating in the second rotation direction;

wherein the controller controls the image forming apparatus to perform a toner removing operation in which whenever the normal image forming operation is ended, the at least one image bearer is rotated with a predetermined travel length in the second rotation direction;

wherein a travel length of the at least one image bearer in the inverse rotation operation is longer than the travel length of the at least one image bearer in the toner removing operation.

2. The image forming apparatus according to claim 1, wherein the controller controls the toner image forming device to perform, as the special image forming operation, a toner pattern forming operation in which a predetermined toner pattern is formed on the surface of the at least one image bearer and then input to the at least one cleaning blade without being transferred.

3. The image forming apparatus according to claim 2, further comprising:

a temperature detector to detect an internal temperature of the image forming apparatus, wherein the controller determines whether or not the toner pattern forming operation is performed based on an index value calculated based on one of an operating time of the image forming apparatus and a parameter relating to the operating time of the image forming apparatus, and the internal temperature of the image forming apparatus detected by the temperature detector.

4. The image forming apparatus according to claim 1, including two or more rotatable image bearers and two or more cleaning blades contacted with the surfaces of the two or more image bearers, respectively, wherein the image forming apparatus includes a black image forming unit including one of the two or more image bearers and one of the two or more cleaning blades corresponding to the one of the two or more image bearers to form a black toner image on the surface of the one of the two or more image bearers, and one or more color image forming units each including another one of the two or more image bearers and another one of the two or more cleaning blades corresponding to the another one of the two or more image bearers to form a color toner image on the surface of the another one of the two or more image bearers, wherein the controller controls the image forming apparatus such that when only the black image forming unit performs the special image forming operation, only the black image forming unit performs the inverse rotation operation, and when one of the one or more color image forming units performs the special image forming operation, all of the one or more color image forming units perform the inverse rotation operation.

5. An image forming method comprising:

performing a normal image forming operation in which an image of toner is formed on a surface of an image bearer rotating in a first rotation direction;

transferring the toner image on the image bearer rotating in the first rotation direction to a recording medium eventually in the normal image forming operation;

blocking the toner with a cleaning blade, which the toner remains on the surface of the image bearer without being transferred and which is input to the cleaning blade due to rotation of the image bearer in the first rotation direction, to clean the surface of the image bearer;

performing a special image forming operation in which a special toner image is formed on the surface of the image bearer and then input to the cleaning blade in such a manner that an amount of the toner input to the cleaning blade in the special image forming operation is greater than an amount of the toner input to the cleaning blade in the normal image forming operation;

performing an inverse rotation operation to rotate the image bearer in a second rotation direction opposite to the first rotation direction after performing the special image forming operation and then stopping the image bearer; and performing a toner removing operation in which whenever the normal image forming operation is ended, the at least one image bearer is rotated with a predetermined travel length in the second rotation direction;

wherein a travel length of the at least one image bearer in the inverse rotation operation is longer than the travel length of the at least one image bearer in the toner removing operation.

* * * * *